US008346126B2

(12) United States Patent
Okabe

(10) Patent No.: US 8,346,126 B2
(45) Date of Patent: Jan. 1, 2013

(54) IMAGE FORMING APPARATUS AND DEVELOPING CARTRIDGE

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 466 days.

(21) Appl. No.: 12/643,289

(22) Filed: Dec. 21, 2009

(65) Prior Publication Data

US 2010/0166453 A1 Jul. 1, 2010

(30) Foreign Application Priority Data

Dec. 26, 2008 (JP) ..... 2008-334379

(51) Int. Cl.
*G03G 15/04* (2006.01)
*G03G 21/16* (2006.01)

(52) U.S. Cl. ..... 399/111; 399/119

(58) Field of Classification Search ..... 399/111, 399/119

See application file for complete search history.

(56) References Cited

U.S. PATENT DOCUMENTS

| | | | | |
|---|---|---|---|---|
| 5,019,867 | A * | 5/1991 | Yamakawa et al. | 399/119 |
| 7,272,339 | B2 * | 9/2007 | Tsuzuki et al. | 399/111 |
| 2004/0062566 | A1 * | 4/2004 | Kato et al. | 399/110 |
| 2005/0152716 | A1 * | 7/2005 | Agata et al. | 399/223 |
| 2007/0071481 | A1 * | 3/2007 | Kamimura | 399/90 |
| 2007/0077087 | A1 * | 4/2007 | Okabe et al. | 399/111 |
| 2007/0160386 | A1 | 7/2007 | Kawamura | |
| 2007/0160388 | A1 | 7/2007 | Yoshimura et al. | |
| 2007/0177899 | A1 | 8/2007 | Kawamura | |
| 2007/0183814 | A1 | 8/2007 | Kamimura | |
| 2007/0217817 | A1 * | 9/2007 | Shiraki et al. | 399/111 |
| 2007/0217818 | A1 * | 9/2007 | Shiraki et al. | 399/111 |
| 2008/0159781 | A1 * | 7/2008 | Noguchi et al. | 399/110 |
| 2008/0240778 | A1 * | 10/2008 | Ishikawa et al. | 399/119 |
| 2009/0252530 | A1 * | 10/2009 | Nakashima | 399/119 |

FOREIGN PATENT DOCUMENTS

| | | |
|---|---|---|
| JP | 2-064570 A | 3/1990 |
| JP | 2007-178654 | 7/2007 |
| JP | 2007-213023 | 8/2007 |
| JP | 2007-213024 | 8/2007 |
| JP | 2007-213025 | 8/2007 |

OTHER PUBLICATIONS

CN Office Action dtd Nov. 24, 2011, CN Appln. 200910215123.6, English Translation.

Notification of Reasons for Refusal dispatched Nov. 9, 2010 in Japanese Patent Application No. 2008-334379 and English translation thereof.

* cited by examiner

*Primary Examiner* — Walter L Lindsay, Jr.
*Assistant Examiner* — David Bolduc
(74) *Attorney, Agent, or Firm* — Banner & Witcoff, Ltd.

(57) ABSTRACT

An image forming apparatus includes a drum unit which holds plural photosensitive drums, a developing cartridge which is provided for each photosensitive drum, a translation member which is provided to be movable linearly, and a movable member for each developing cartridge. The movable member includes a main body rotatably supported by the supporting shaft at one end portion thereof, an input portion provided at the other end portion thereof and to which a pressing force is input by the translation member with the linear movement thereof; an abutting portion which is provided between the one and other end portions of the main body, and abuts the drum unit while the movable member rotates about the supporting shaft; and an operating portion which applies to the supporting shaft a force for moving the developing cartridge as the movable member is rotated with the middle portion as a fulcrum.

17 Claims, 20 Drawing Sheets

IMAGE FORMING APPARATUS AND DEVELOPING CARTRIDGE

CROSS-REFERENCE TO RELATED APPLICATION

This application claims priority from Japanese Patent Application No. 2008-334379, filed on Dec. 26, 2008, the entire subject matter of which is incorporated herein by reference.

TECHNICAL FIELD

Aspects of the present invention relate to an image forming apparatus, such as a color laser printer, and a developing cartridge detachably mounted in the image forming apparatus.

BACKGROUND

As an electrophotographic color printer, a tandem electrophotographic color printer in which photosensitive drums corresponding to yellow, magenta, cyan, and black colors, respectively, are arranged in parallel with each other is known.

The tandem color printer is provided with a developing device which holds a developing roller so as to oppose each photosensitive drum. An electrostatic latent image is formed on the surface of the photosensitive drum. When the electrostatic latent image opposes the developing roller with the rotation of the photosensitive drum, toner is supplied to the electrostatic latent image from the developing roller, so that a toner image is formed on the surface of the photosensitive drum. Specifically, for color image formation, toner images of colors corresponding to the photosensitive drums, respectively, are formed, and the toner images of the respective colors are superposed on and transferred to a sheet conveyed by a belt. For monochrome image formation, only a black toner image is formed on a photosensitive drum for black, and the black toner image is transferred to a sheet.

At monochrome image formation, since any toner image is not formed on the photosensitive drums for yellow, magenta, and cyan other than black, it is advantageous to separate developing rollers from the photosensitive drums to reduce or prevent the wear of the developing rollers.

A tandem image forming apparatus includes a translation cam member which is linearly movable in an array direction of photosensitive drums, and an intermediate member which is displaced by the linear movement of the translation cam member, and presses a developing device upward to separate a photosensitive drum from a developing roller. Specifically, the linear movement of the translation cam member realize switching among an all-color separation state where developing rollers are separated from all the photosensitive drums, a black contact state where a developing roller contacts a photosensitive drum for black, and other developing rollers are separated from photosensitive drums for yellow, magenta, and cyan, respectively, and an all-color contact state where the developing rollers contact all the photosensitive drums, respectively.

Additionally, in the tandem image forming apparatus, the photosensitive drums for four colors are collectively held in a drum unit, and the drum unit is detachably mounted in an apparatus body. Further, developing devices for respective colors are detachably mounted in the drum unit.

However, in the above-described tandem image forming apparatus, when a developing device is pressed upward by the intermediate member and the developing device is moved, an upward force acts even on the drum unit with respect to the apparatus body due to the friction or the like between the developing roller and the drum unit. Accordingly, it is possible that the position of the drum unit with respect to the apparatus body deviates. If the position of the drum unit deviates, the position of an image to be formed on a sheet also deviates.

SUMMARY

It is an aspect of the present invention to provide an image forming apparatus, and a developing cartridge detachably mounted in the image forming apparatus which can reduce or prevent the position of a photosensitive drum unit with respect to an apparatus body from deviating when a developing roller is separated from a photosensitive drum.

According to an exemplary embodiment of the present invention, there is provided an image forming apparatus comprising: an apparatus body; a tandem photosensitive drum unit which holds a plurality of photosensitive drums to be in parallel with each other, and is movably mounted in the apparatus body along an array direction of the photosensitive drums; a developing cartridge which is provided for each of the photosensitive drums, supports a developing roller for supplying developer to the corresponding photosensitive drum, and is detachably mounted in the tandem photosensitive drum unit; a translation member which is provided in the apparatus body to be movable linearly in the array direction; a supporting shaft which is provided on each of the developing cartridges; and a movable member which is rotatably supported by the supporting shaft, and provided at a position where the translation member abuts along a linear movement thereof. The movable member includes: a main body which extends in a direction orthogonal to the supporting shaft, and is rotatably supported by the supporting shaft at a first end portion of the main body in a longitudinal direction thereof; an input portion which is provided at a second end portion of the main body opposite to the first end portion, and to which a pressing force is input by the translation member with the linear movement of the translation member after abutting the input portion; an abutting portion which is provided at a middle portion between the first and second end portions of the main body, and abuts the tandem photosensitive drum unit while the movable member rotates about the supporting shaft by the input of the pressing force to the input portion; and an operating portion which applies to the supporting shaft a force for moving the developing cartridge from a first position where the developing roller contacts the photosensitive drum to a second position where the developing roller is separated from the photosensitive drum as the movable member is rotated with the middle portion as a fulcrum by the input of the pressing force to the input portion while the abutting portion abuts the tandem photosensitive drum unit.

According to another exemplary embodiment of the present invention, there is provided a developing cartridge to be detachably mountable in an apparatus body of an image forming apparatus. The developing cartridge comprises: a developing roller which is configured to supply developer to a photosensitive drum; a supporting shaft; and a movable member which is rotatably supported by the supporting shaft. The movable member includes: a main body which extends in a direction orthogonal to the supporting shaft, and is rotatably supported by the supporting shaft at a first end portion of the main body in a longitudinal direction thereof; an input portion which is provided at a second end portion of the main body opposite to the first end portion, and to which a pressing force is input from an external member; an abutting portion which is provided at a middle portion between the first and second end portions of the main body, and abuts a predetermined portion in the apparatus body while the movable member rotates about the supporting shaft by the input of the pressing force to the input portion; and an operating portion which applies to the supporting shaft a force for moving the developing cartridge from a first position where the developing roller contacts the photosensitive drum to a second position where the developing roller is separated from the photosensitive drum as the movable member is rotated with the middle portion as a fulcrum by the input of the pressing force to the input portion while the abutting portion abuts the predetermined portion.

According to another exemplary embodiment of the present invention, there is provided an image forming apparatus comprising: an apparatus body; a drum unit which holds a photosensitive drum, and is movably mounted along a first direction orthogonal to an axial direction of the photosensitive drum; a developing cartridge which supports a developing roller for supplying developer to the photosensitive drum, and is detachably mounted in the drum unit, the developing cartridge including a supporting shaft extending along the axial direction; a translation member in the apparatus body to be movable linearly in the first direction; and a movable member. The movable member includes: a first part provided at one end thereof, and rotatably supported by the supporting shaft; a second part provided at the other end thereof and located at a position abatable on the translation member moving linearly to rotate the movable member about the supporting shaft; a middle part provided between the first part and second part, and configured to abut the drum unit when the movable member rotates by the abutment between the translation member and the second part.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will be described below in detail with reference to the accompanying drawings.

1. Printer

Figure 1:
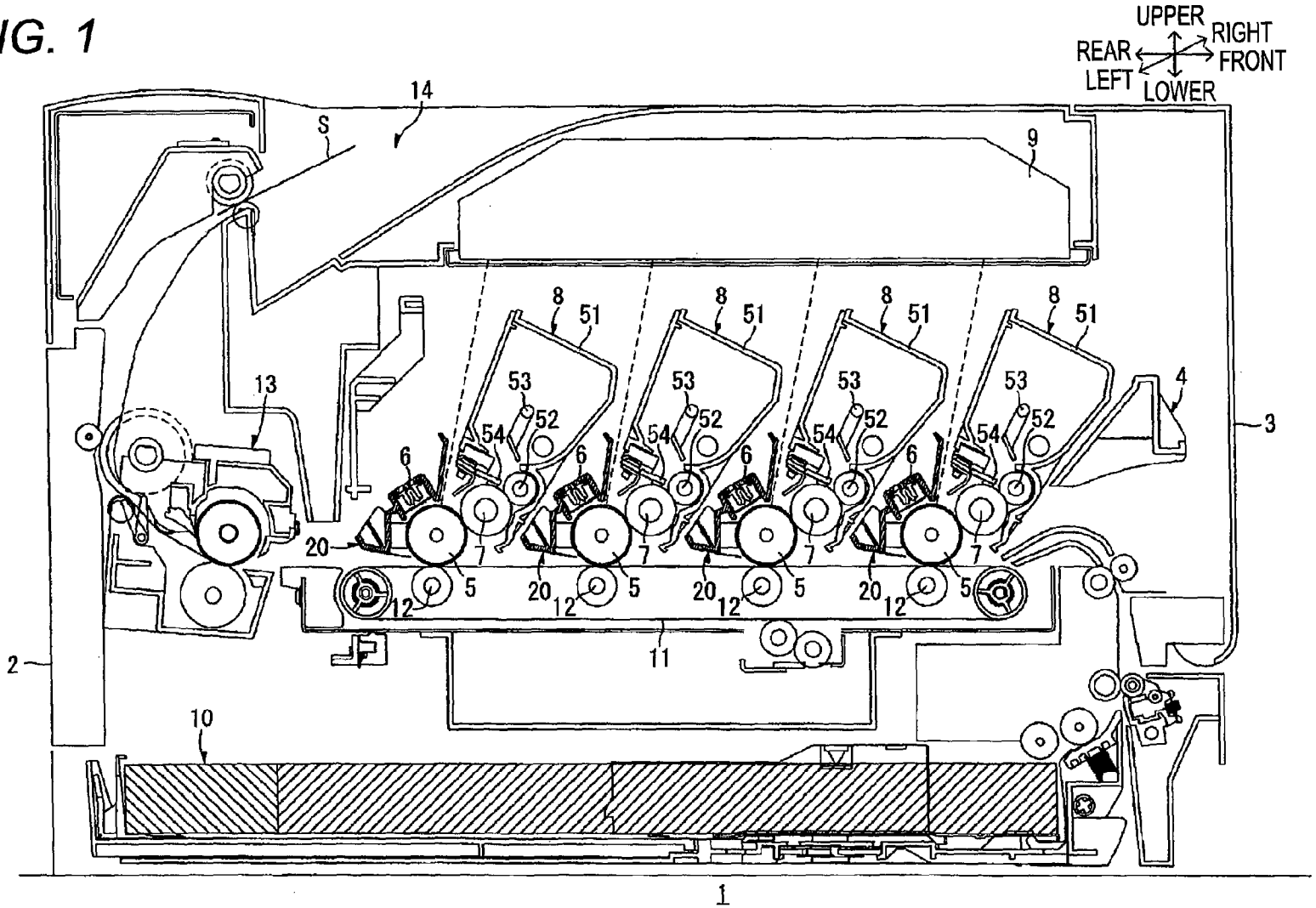
FIG. 1 is a sectional side view showing a printer as an example of an image forming apparatus according to an exemplary embodiment of the present invention.

A printer 1 is shown in FIG. 1 as an example of an image forming apparatus according to an exemplary embodiment of the present invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as a width direction, and the upper-lower direction is also referred to as a vertical direction. The left-right direction and the front-rear direction are also referred to as a horizontal direction. With regard to various individual components of the printer 1, sides of the individual components are similarly identified based on the arranged/attached position of the components on/in the printer 1.

The printer 1 is a tandem color laser printer. The printer 1 includes a body casing 2 (as an example of an apparatus body). A front cover 3 is openably and closably provided on one side face of the body casing 2.

A drum unit 4 (as an example of a tandem photosensitive drum unit) is provided within the body casing 2. The drum unit 4 is mounted in and detached from the inside of the body casing 2 via an opening formed in the front face of the body casing 2 in a state where the front cover 3 is opened.

Four photosensitive drums 5 are provided along the front-rear direction in the drum unit 4 in a state where the drums 5 are rotatable. A scorotron type charger 6 and a developing roller 7 are provided to oppose each photosensitive drum 5. Additionally, a developing cartridge 8 which supports the developing roller 7 and stores toner (developer) is provided adjacent to each photosensitive drum 5. The developing cartridge 8 is mountable in and detachable from the drum unit 4. The toner of the developing cartridge 8 is carried on the surface of the developing roller 7.

After the surface of each photosensitive drum 5 is uniformly charged by the charger 6, the surface is exposed by a laser beam (refer to a dashed arrow) emitted from a scanner unit 9 provided in an upper part of the body casing 2. Accordingly, an electrostatic latent image based on image data is formed on the surface of each photosensitive drum 5. The electrostatic latent image of each photosensitive drum 5 is visualized into a toner image by the toner carried on the surface of the developing roller 7 corresponding to each photosensitive drum 5. Here, since the color of the toner stored in each developing cartridge 8 differs according to each developing cartridge 8, the color of the toner image on each photosensitive drum 5 differs according to each photosensitive drum 5.

A sheet feed cassette 10 which stores sheets S is provided at the bottom of the body casing 2. The sheet S stored in the sheet feed cassette 10 is conveyed onto a conveyor belt 11 by various rollers. The conveyor belt 11 is provided to oppose the four photosensitive drums 5 from below. A transfer roller 12 is provided at each position opposing the photosensitive drum 5 with an upper part of the conveyor belt 11 therebetween. A sheet S conveyed onto the conveyor belt 11 passes between the conveyor belt 11 and each photosensitive drum 5 sequentially by the moving of the conveyor belt 11. Then, a toner image on the surface of the photosensitive drum 5 is transferred to the sheet S by a transfer bias applied to the transfer roller 12 when the toner image opposes the sheet S.

A fixing device 13 is provided on the downstream side of the conveyor belt 11 in the conveying direction of the sheet S. The sheet S to which the toner image has been transferred is conveyed to the fixing device 13. In the fixing device 13, the toner image is fixed on the sheet S by heating and pressurization. The sheet S on which the toner image has been fixed is discharged by various rollers to a sheet discharge tray 14 on the upper face of the body casing 2.

2. Drum Unit

Figure 2:
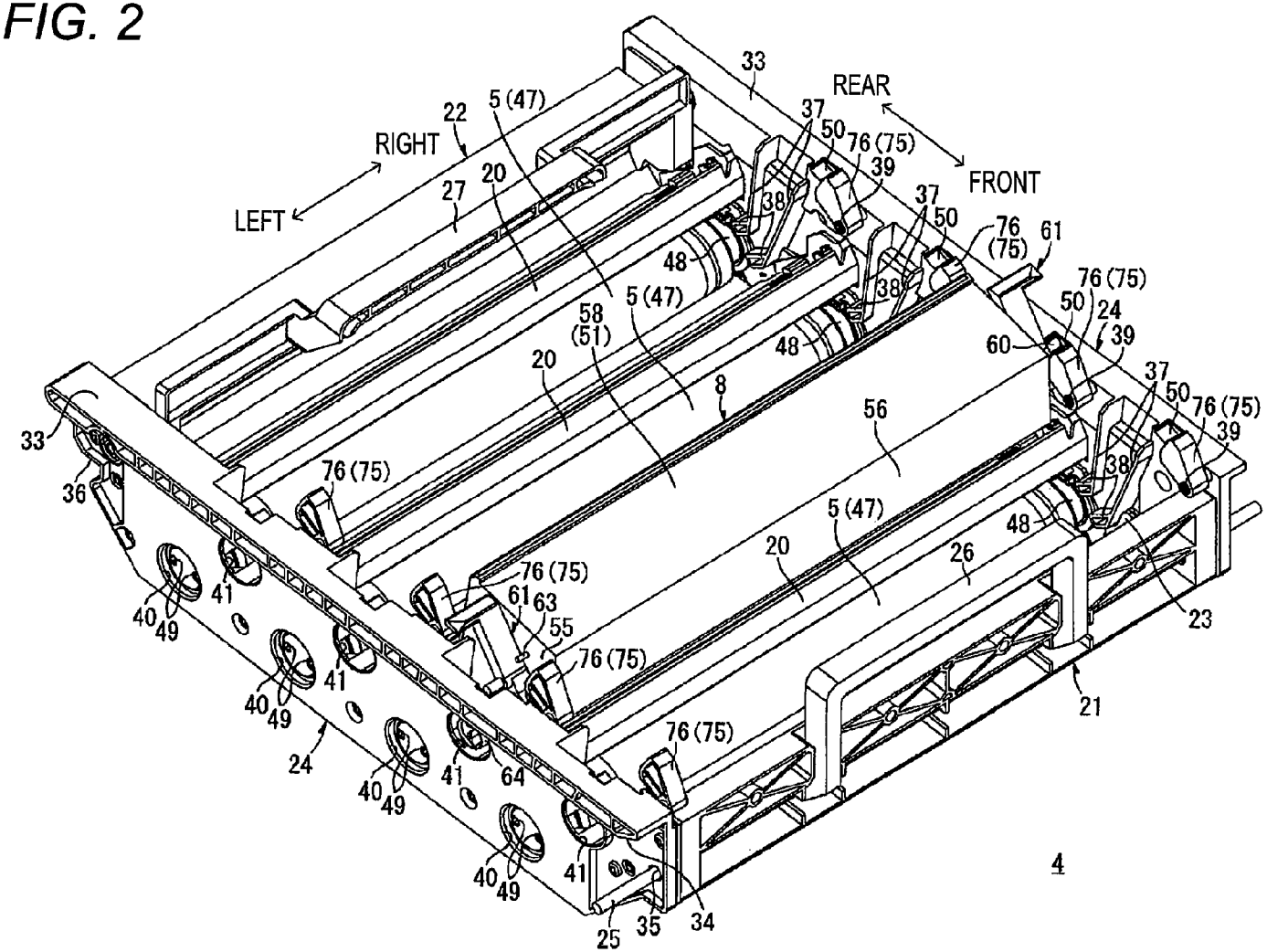
FIG. 2 is a perspective view seen from the upper front left side of a drum unit, in which one developing cartridge is mounted, and the other developing cartridges have been detached.

As shown in FIG. 2, the drum unit 4 includes, as a unit, four photosensitive drums 5, four developing cartridges 8, four drum subunits 20, a front beam 21, a rear beam 22, a pair of first side plates 23, and a pair of second side plates 24, and is slidably mounted in and detached from the inside of the body casing 2 (refer to FIG. 1).

(1) Drum Subunit

The four drum subunits 20 are provided at intervals in the front-rear direction between the pair of first side plates 23. Each drum subunit 20 is made of resin, is elongated in the width direction, and is formed in the shape of a substantially triangular prism which is opened to the lower front side. The charger 6 shown in FIG. 1 and a cleaning member (not shown) for cleaning of the surface of the photosensitive drum 5 are held in each drum subunit 20.

(2) Front Beam

The front beam 21 is made of resin. The front beam 21 is provided between the front ends of the pair of first side plates 23.

The front beam 21 holds a supporting shaft 25. The supporting shaft 25 passes through the front beam 21 along the width direction, protrudes outward in the width direction from the front beam 21, and protrudes outward in the width direction through the first side plates 23 and the second side plates 24.

A front-side grip portion 26 is rotatably supported by the supporting shaft 25. The front-side grip portion 26 is provided at the central portion of the front beam 21 in the width direction. The front-side grip portion 26 is substantially U-shaped, and is provided so as to be rotatably supported by the supporting shaft 25 at each free end and switchable between a housed position where the grip portion rises along the front beam 21 and an operation position where the grip portion is tilted to the front side of the front beam 21.

(3) Rear Beam

The rear beam 22 is made of resin. The rear beam 22 is provided between rear ends of the pair of first side plates 23.

A rear-side grip portion 27 is integrally formed at the central portion of the upper face of the rear beam 22 in the width direction. The rear-side grip portion 27 is substantially U-shaped in rear view, and is provided so as to be connected to the rear beam 22 at each free end, and incline from the lower rear side to the upper front side to protrude obliquely upward from the rear beam 22.

(4) First Side Plate

The right and left first side plates 23 are made by press working of a metal sheet using the same press die, and have the same shape.

Figure 5:
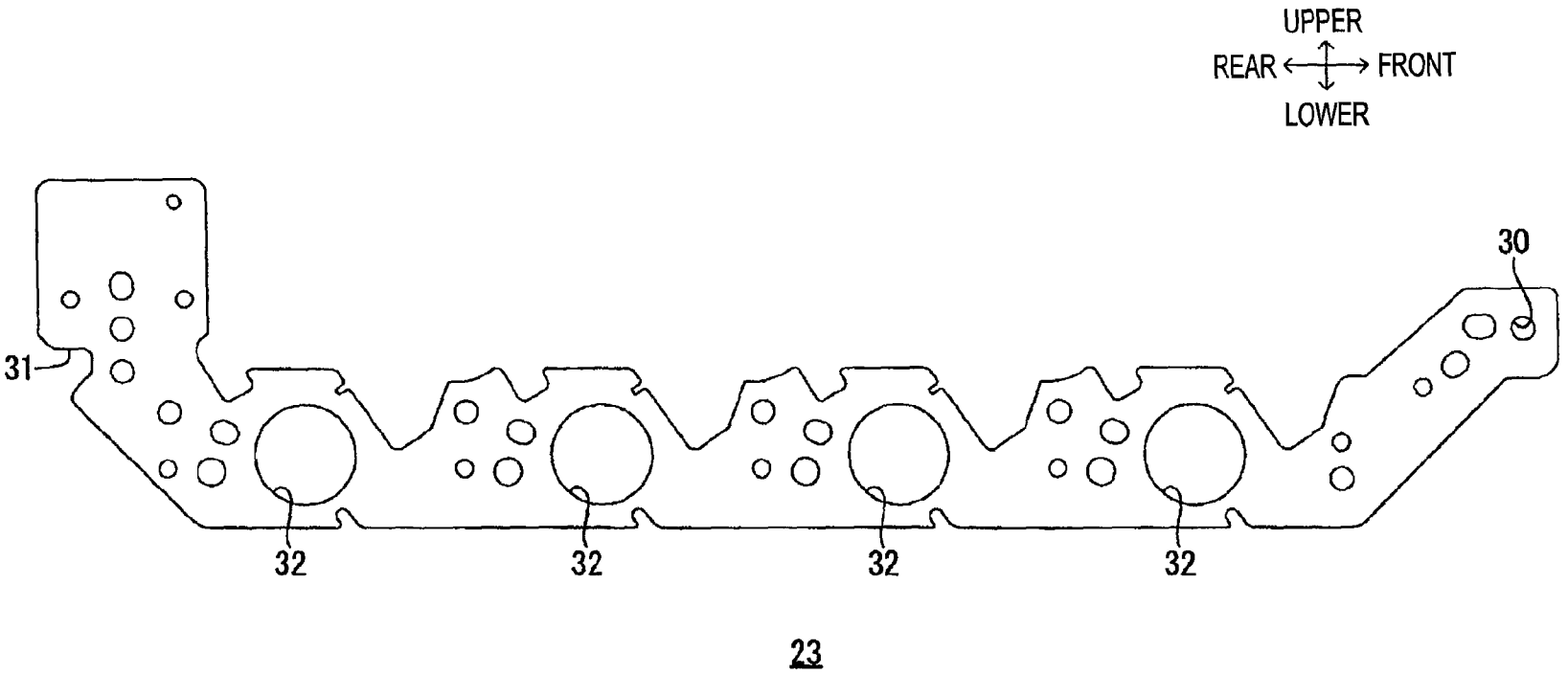
FIG. 5 is a left side view of a first side plate.

The first side plates 23, as shown in FIG. 5, are formed in the shape of a substantially elongated rectangular plate which extends in the front-rear direction. The front end and the rear end of each first side plate 23 opposes the front beam 21 and rear beam 22 shown in FIGS. 2 and 3, respectively, in the right-left direction.

The front end of the first side plate 23 extends towards the upper front side. A supporting shaft insertion hole 30 through which the supporting shaft 25 is inserted is formed at the front end of the first side plate 23 so as to pass therethrough.

The rear end of the first side plate 23 is formed in a substantially L-shape in side view. More specifically, the rear end of the first side plate 23 inclines towards the upper rear side, and is formed in a shape which extends towards the upper side.

The rear end of the first side plate 23 is formed with a cutout portion 31 which is cut out in a substantial V-shape from the rear end edge of the first side plate 23. Specifically, the cutout portion 31 is formed in a shape having an upper end edge which extends in the front-rear direction in side view, a lower end edge which inclines at a predetermined gradient towards the upper front side, and a front end edge which connects the front end of the upper end edge and the front end of the lower end edge.

The first side plate 23 is formed with four circular drum supporting holes 32. The drum supporting holes 32 are formed at predetermined intervals in the front-rear direction between the front end and the rear end of the first side plate 23.

(5) Second Side Plate

The second side plate 24 is made of, for example, fiber reinforced resin. The second side plate 24, as shown in FIGS. 6A to 7B, is formed in the shape of a substantially elongated rectangular plate in side view, which is wide in the upper-lower direction and has almost the same length in the front-rear direction as compared with the first side plate 23 (refer to FIG. 5). The front end and the rear end of each second side plate 24 oppose the front beam 21 and the rear beam 22 shown in FIGS. 2 and 3, respectively, in the right-left direction.

The front end of the second side plate 24 is formed narrower in the upper-lower direction than a middle portion of the second side plate 24, and the lower end edge of the second side plate inclines towards the upper front side. Additionally, the rear end of the second side plate 24 is formed narrower in the upper-lower direction than the middle portion of the second side plate 24, and the lower end edge of the second side plate inclines towards the upper rear side.

Figure 6A:
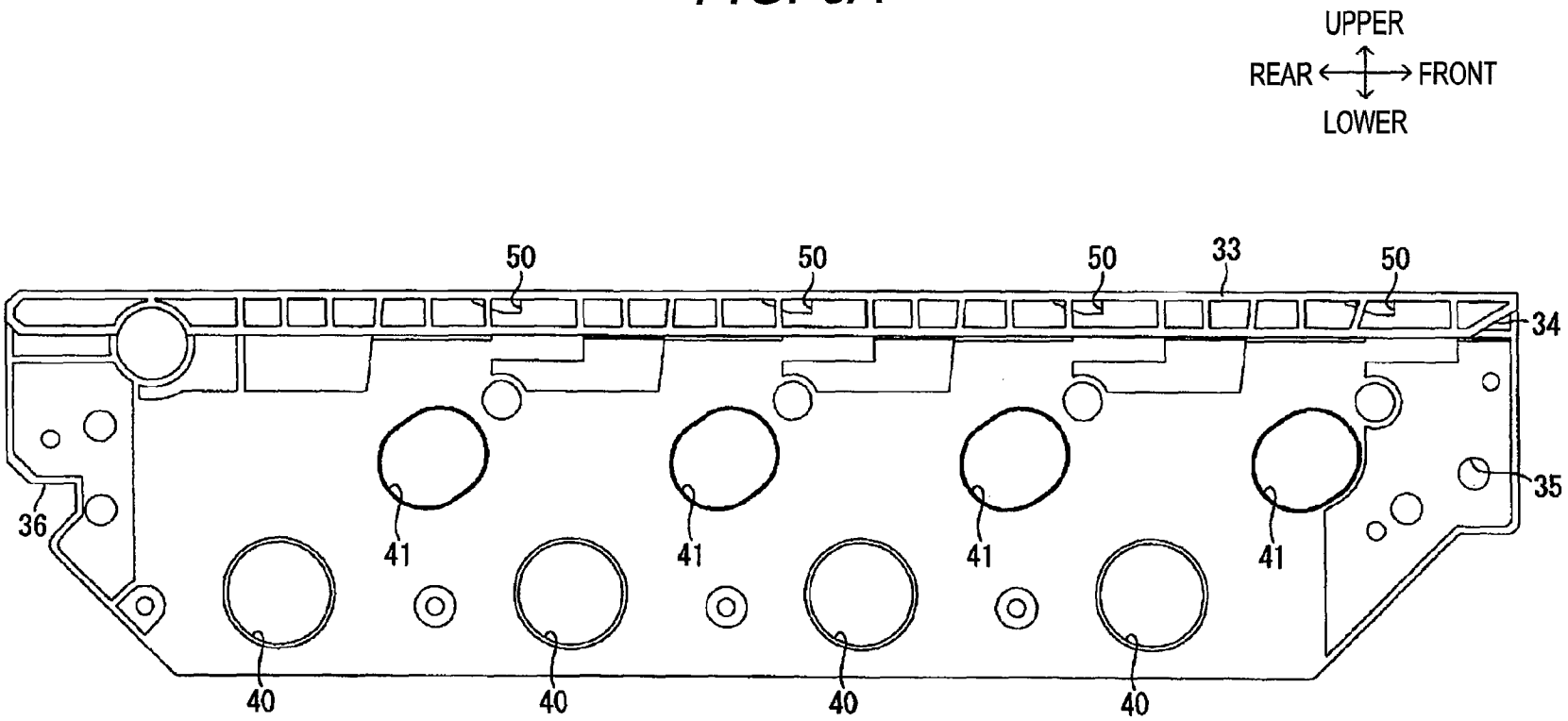
FIG. 6A is a left side view of a left second side plate.
Figure 7A:
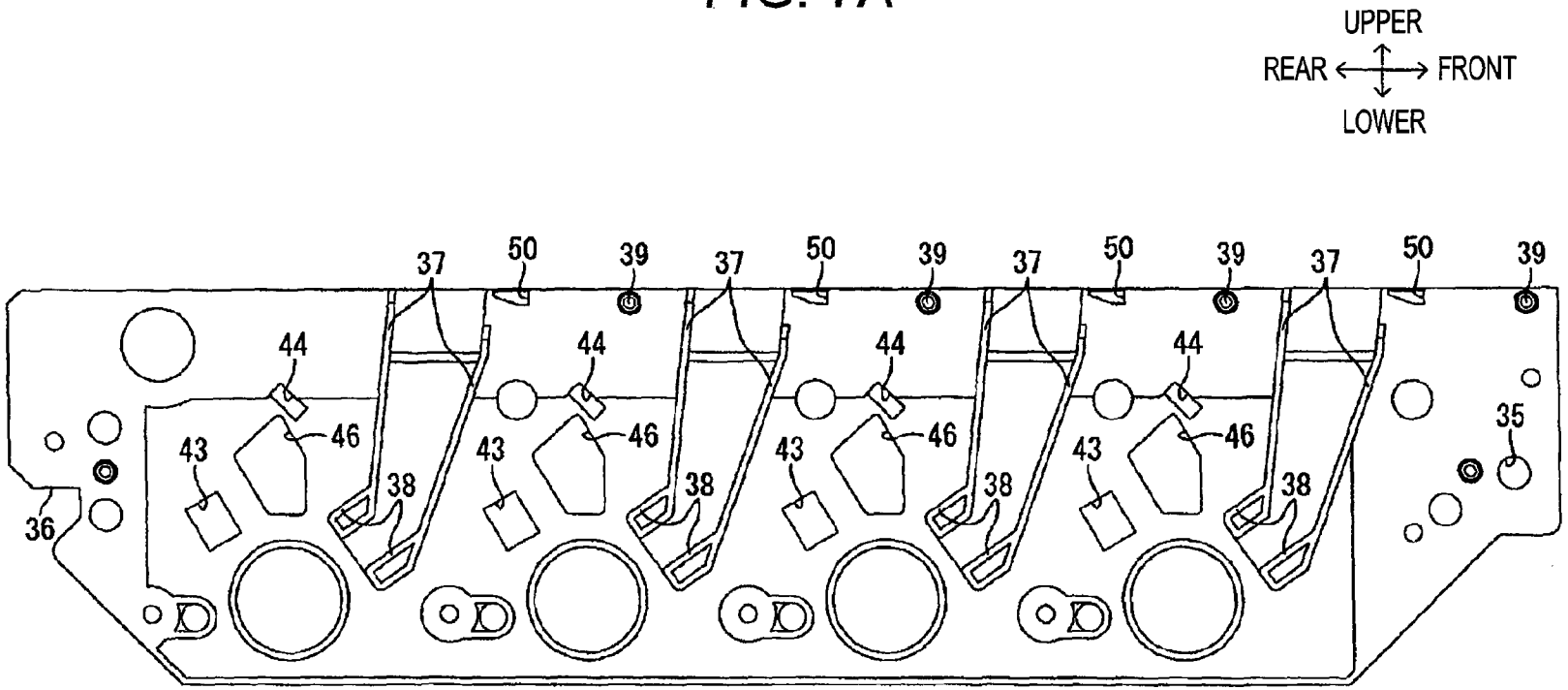
FIG. 7A is a left side view of a right second side plate.
Figure 7B:
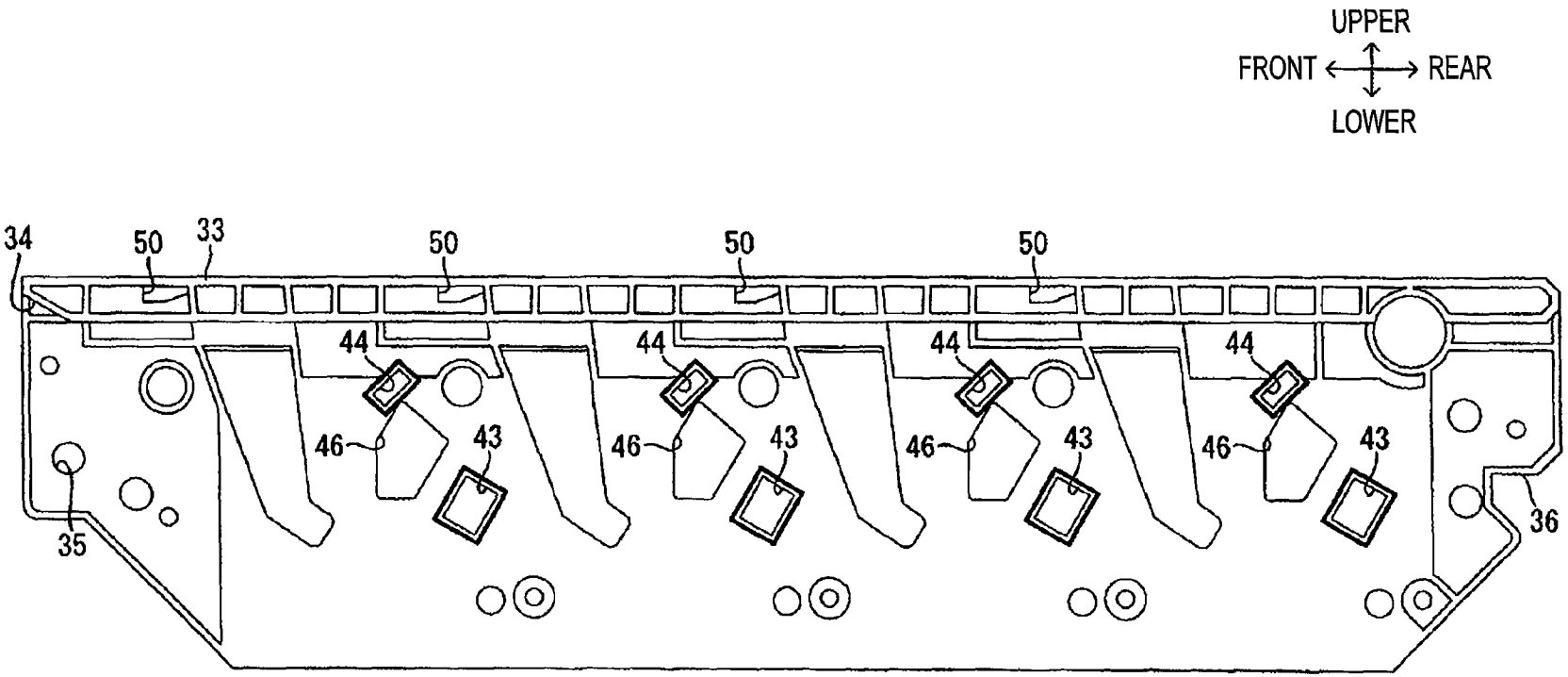
FIG. 7B is a right side view of the right second side plate.

As shown in FIGS. 6A and 7B, the upper end of the second side plate 24 is formed with a flange portion 33 which extends outward of the width direction and extends in the front-rear direction. The front end of the flange portion 33 is formed with an inclined surface 34 which inclines towards the upper front side from the bottom face of the flange portion 33.

A supporting shaft insertion hole 35 through which the supporting shaft 25 (refer to FIGS. 2 and 3) is inserted is formed at the front end of the second side plate 24.

A cutout portion 36 which has almost the same shape as the cutout portion 31 is formed in the position where the cutout portion opposes the cutout portion 31 (refer to FIG. 5) of the first side plate 23 in the width direction at the rear end of the second side plate 24.

Figure 6B:
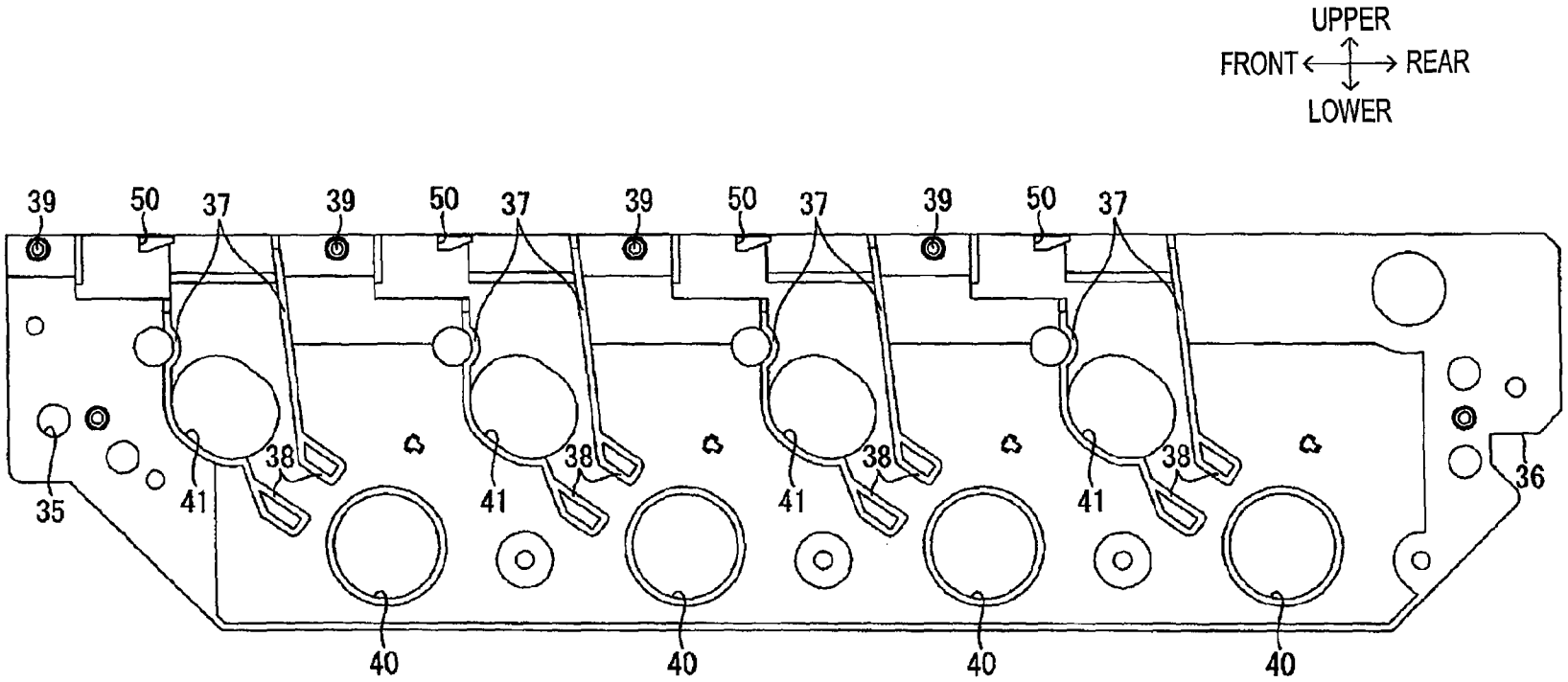
FIG. 6B is a right side view of the left second side plate.

As shown in FIGS. 6B and 7A, four cartridge guide portions 37 for guiding the mounting and detaching of the developing cartridge 8 (refer to FIGS. 2 and 3) to/from the right and left second side plates 24 are formed at predetermined intervals in the front-rear direction on the faces (the right side face of the left second side plate 24 and the left side face of the second right side plate 24) inside the second side plates 24 in the width direction. Each cartridge guide portion 37 is formed from two ridges which protrude towards the inside in the width direction from the internal surface of the second side plate 24 and are formed at predetermined intervals. The cartridge guide portion 37 inclines at a predetermined gradient towards the lower rear side from the upper end of the second side plate 24, and is connected with a cartridge holding portion 38. The cartridge holding portion 38 is formed parallel to a line which connects the center of the photosensitive drum 5 and the center of the developing roller 7 which are shown in FIG. 1, and the lower end thereof is opened towards the photosensitive drum 5.

Additionally, four second supporting shafts 39 are provided at predetermined intervals in the front-rear direction at the upper end of the internal surface of the second side plate 24 so as to protrude therefrom. Each second supporting shaft 39 is provided in a position spaced forward from the upper end of each cartridge guide portion 37.

Additionally, four abutting grooves 50 are provided at predetermined intervals in the front-rear direction at the upper end of the internal surface of the second side plate 24. Each abutting groove 50 is provided in a position spaced rearward from corresponding second supporting shaft 39.

(5-1) Left Second Side Plate

As shown in FIGS. 6A and 6B, the left second side plate 24 is formed with a drum coupling insertion hole 40 which exposes the axial left end of each photosensitive drum 5 (refer to FIG. 2).

Four drum coupling insertion holes 40 are formed at predetermined intervals in the front-rear direction at the lower end of the second side plate 24. Each drum coupling insertion hole 40 is formed as a circular hole passing through the second side plate 24 in the thickness direction in the position where the insertion hole opposes the axial left end of each photosensitive drum 5 and the drum supporting hole 32 provided in the first side plate 23 in the width direction.

Additionally, a development coupling insertion hole 41 is formed at a middle portion of each cartridge guide portion 37 in the upper-lower direction in the left second side plate 24. As shown in FIG. 2, a development coupling 64 provided on the left side face of the developing cartridge 8 opposes each development coupling insertion hole 41 in a state where each developing cartridge 8 is mounted between the right and left second side plates 24.

(5-2) Right Second Side Plate

As shown in FIGS. 7A and 7B, the right second side plate 24 is formed with four charging grid electrode openings 43, four charging wire electrode openings 44, and four air intake holes 46.

Each charging grid electrode opening 43 is formed as a rectangular hole in side view passing through the right second side plate 24 in the thickness direction in the position where the electrode opening opposes, in the width direction, a charging grid electrode (not shown) for feeding of power to a grid electrode of the charger 6 (refer to FIG. 1) behind a lower end of each cartridge guide portion 37. Thereby, since the charging grid electrode of the charger 6 is exposed through each charging grid electrode opening 43, power can be fed to the grid electrode of the charger 6 by connecting a body-side electrode to the charging grid electrode.

When the drum unit 4 is assembled, each charging wire electrode opening 44 is formed as a rectangular hole in side view passing through the right second side plate in the thickness direction in the position where the electrode opening faces, in the width direction, a charging wire electrode (not shown) for feeding of power to a wire electrode of the charger 6 (refer to FIG. 1) behind an upper end of each cartridge guide portion 37. Thereby, since the charging wire electrode of the charger 6 is exposed through each charging wire electrode opening 44, power can be fed to the wire electrode of the charger 6 by connecting the body-side electrode to the charging wire electrode.

Each air intake hole 46 is formed between each charging wire electrode opening 44 and each charging grid electrode opening 43. The air intake hole 46 is formed as a hole which passes through the right second side plate in the thickness direction in the position where the air intake hole faces the charger 6 (refer to FIG. 1). The air which has flowed in from the air intake holes 46 is supplied to the charger 6. Additionally, ozone generated from the charger 6 may be discharged out from the drum unit 4 via the air intake holes 46.

(6) Photosensitive Drum

Figure 3:
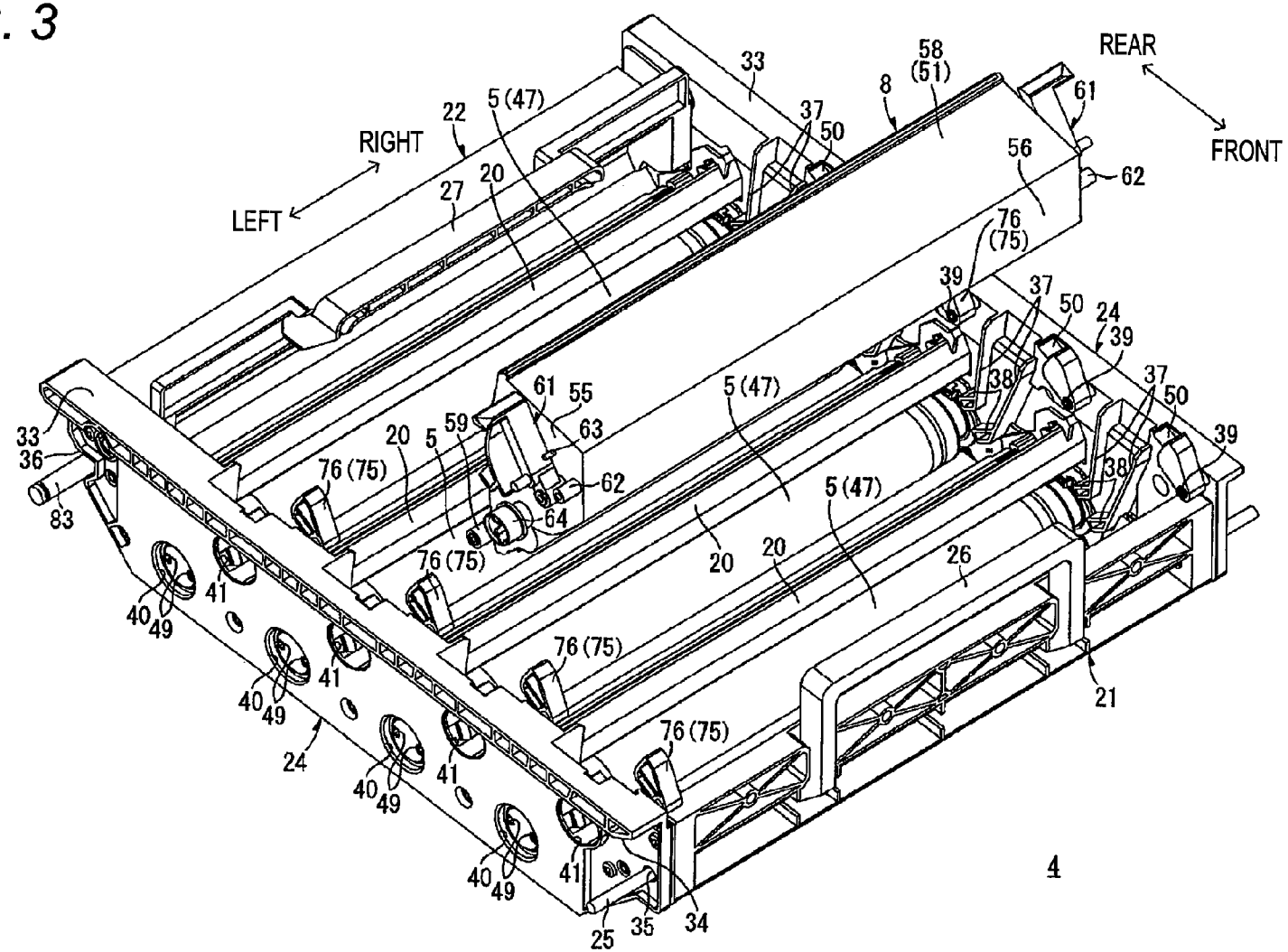
FIG. 3 is a perspective view seen from the upper front left side of the drum unit, in which one developing cartridge is being mounted or detached, and the other developing cartridges have been detached.
Figure 4:
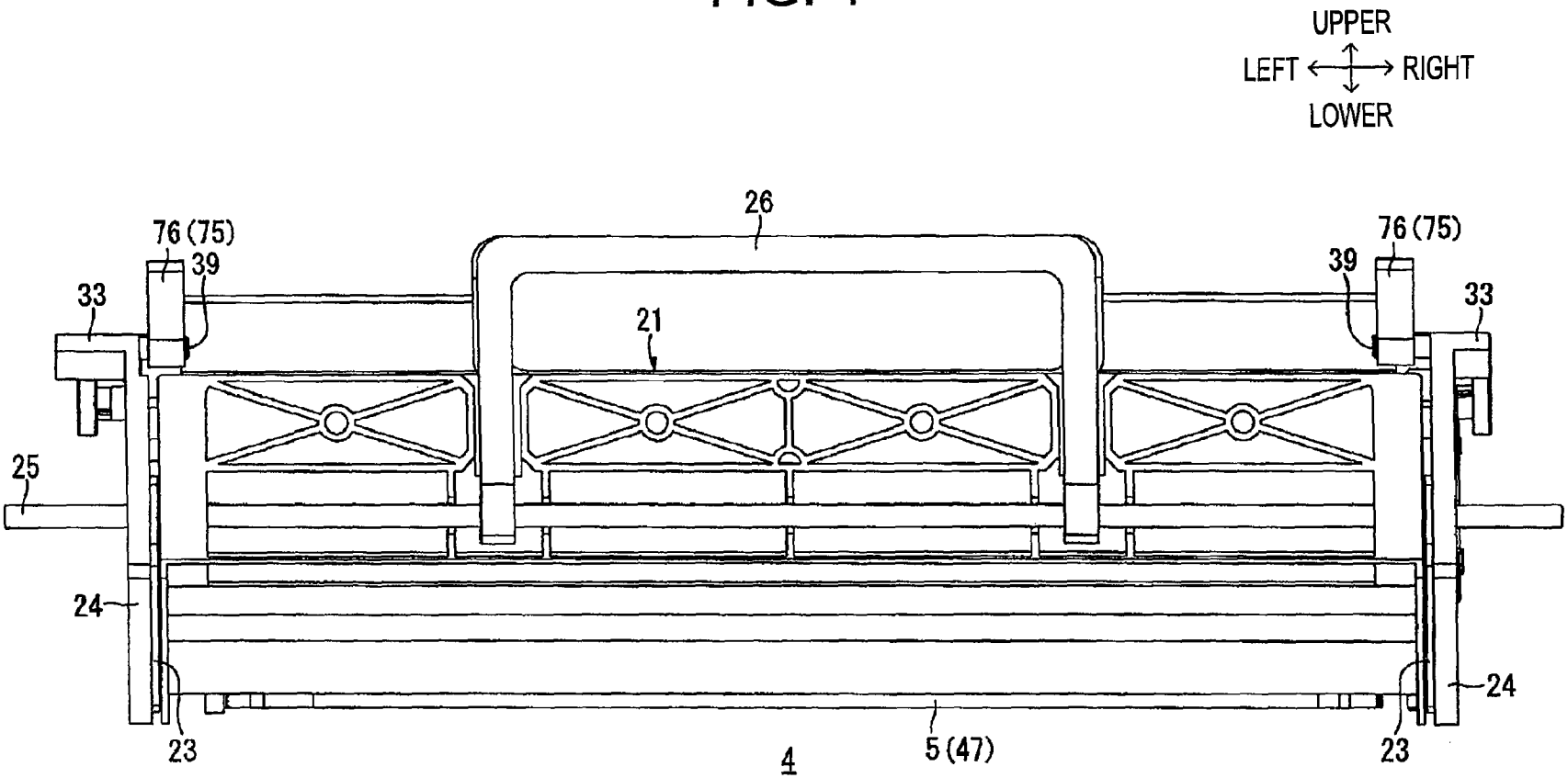
FIG. 4 is a front view of the drum unit.

As shown in FIGS. 2 and 3, the photosensitive drum 5 includes a cylindrical drum body 47, and two flange members 48 which are fitted into both ends of the drum body 47 to be non-rotatable with each other.

The outermost surface layer of the drum body 47 is formed by a photosensitive layer having a positively charged property.

The flange members 48 are made of resin material, and portions thereof are inserted into both ends of the drum body 47. A left end face of the left flange member 48 is provided with a coupling groove 49 which is configured to couple with a driving transmission portion (not shown) provided within the body casing 2. Thereby, as shown in FIG. 1, the driving force from the driving transmission portion is transmitted to the photosensitive drum 5 in a state where the drum unit 4 is mounted into the body casing 2, so that the photosensitive drum 5 can be rotated and driven.

The right and left flange members 48 are supported by bearing members (not shown), respectively, so as to be rotatable with respect to the drum supporting holes 32 (refer to FIG. 5) of the first side plate 23.

3. Developing Cartridge

As shown in FIG. 1, the developing cartridge 8 includes a box-shaped developing frame 51 which is opened to the lower rear side. The developing roller 7, a supply roller 52, an agitator 53, and a thickness regulating blade 54 are provided within the developing frame 51.

The developing roller 7 is adapted such that a portion of the peripheral surface thereof is exposed towards the lower front side from the developing frame 51, and abuts the peripheral surface of the photosensitive drum 5 from the upper front side in a state where the developing cartridge 8 is mounted in the drum unit 4.

The supply roller 52 is provided in the position ahead of and above the developing roller 7, and the peripheral surface thereof press-contacts the peripheral surface of the developing roller 7.

The agitator 53 is provided in an upper position within the developing frame 51 so as to be rotatable about a shaft which extends in the width direction.

The thickness regulating blade 54 has one end fixed to the developing frame 51 and the other end resiliently abutting the peripheral surface of the developing roller 7. Toner corresponding to each color is stored in the developing frame 51.

A portion of the toner within the developing frame 51 is supplied to the supply roller 52 while being agitated within the developing frame 51 by the rotation of the agitator 53. The toner supplied to the supply roller 52 is supplied to the developing roller 7 by the contact between the supply roller 52 and the developing roller 7. The toner supplied to the developing roller 7 is regulated in thickness by the thickness regulating blade 54 with the rotation of the developing roller 7, and is carried on the peripheral surface of the developing roller 7 as a thin layer with a predetermined thickness. Accordingly, when an electrostatic latent image formed on the peripheral surface of the photosensitive drum 5 opposes the developing roller 7, the toner is supplied to the electrostatic latent image from the developing roller 7, and the electrostatic latent image is developed.

(1) Developing Frame

Figure 8:
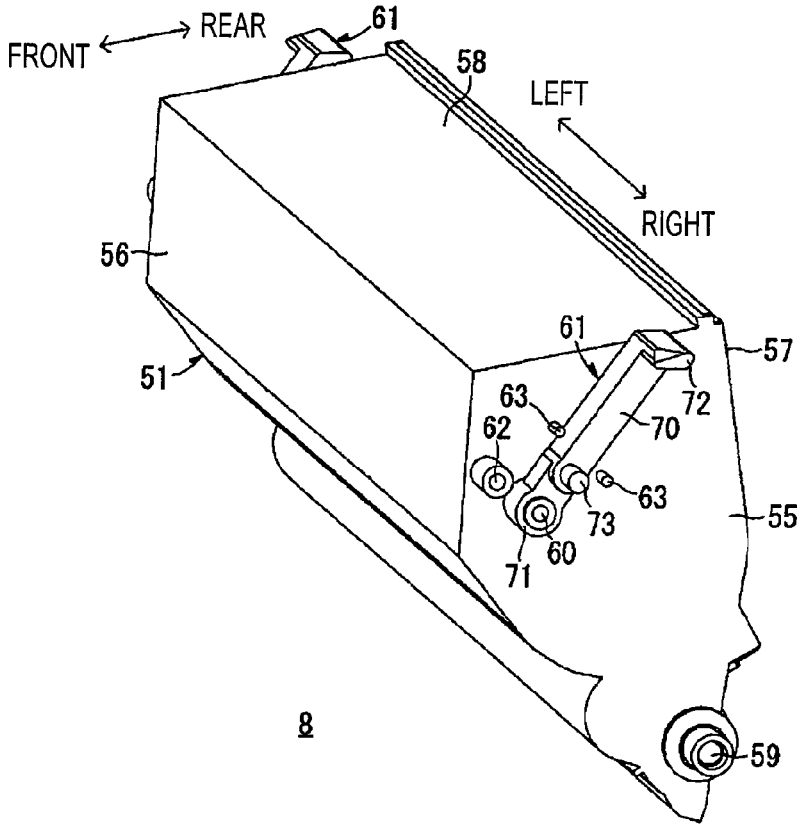
FIG. 8 is a perspective view seen from the upper front right side of a developing cartridge, which is in a first position.
Figure 9:
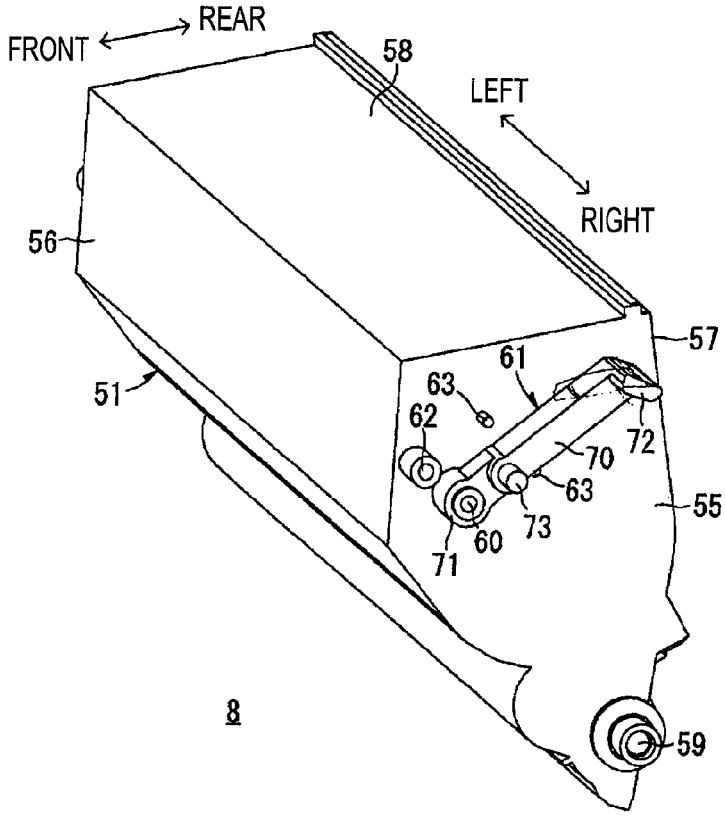
FIG. 9 is a perspective view seen from the upper front right side of a developing cartridge, which is in a second position.

As shown in FIGS. 8 and 9, the developing frame 51 has a pair of right and left side walls 55, and a front wall 56, a rear wall 57 and an upper wall 58 which connect the pair of side walls 55 together, and is formed in a substantially triangular shape in side view.

Both axial ends of a roller shaft 59 of the developing roller 7 (refer to FIG. 1) pass through the lower ends of the side walls 55, and protrude outward in the width direction.

Additionally, a supporting shaft 60 is provided in an upper front position in each side wall 55. The supporting shaft 60 is provided so as to protrude outward in the width direction outside from the side wall 55. A movable member 61 is rotatably supported by the supporting shaft 60.

A developing pressed boss 62 (as an example of a pressed portion) is provided in an upper front position with respect to each supporting shaft 60 so as to protrude outward in the width direction from the side wall 55. Moreover, a spring (not shown) is provided around the supporting shaft 60, and the movable member 61 is biased counterclockwise in FIGS. 8 and 9 by the biasing force of the spring.

Additionally, two regulating bosses 63 for regulating the rotation range of the movable member 61 are provided in two positions, specifically, a rear position and an upper rear position with respect to the supporting shaft 60 so as to protrude outward in the width direction from the side wall 55. As shown in FIG. 3, in the left side wall 55, a development coupling 64 is arranged in an upper front position with respect to the roller shaft 59. The development coupling 64 is connected to a plurality of gears (not shown) for transmitting a rotational driving force to the developing roller 7 and the supply roller 52 (refer to FIG. 1).

As shown in FIG. 2, each development coupling 64 opposes each development coupling insertion hole 41 in a state where each developing cartridge 8 is mounted in the drum unit 4. Then, the driving transmission portion (not shown) for transmitting the driving force from a motor (not shown) provided in the body casing 2 (refer to FIG. 1) is inserted through each development coupling insertion hole 41. As each driving transmission portion is coupled with each the development coupling 64, the rotational driving force can be transmitted to the developing roller 7 and the supply roller 52 (refer to FIG. 1) via each driving transmission portion and the development coupling 64.

(2) Movable Member

As shown in FIGS. 8 and 9, a pair of movable members 61 is provided on both sides of the developing cartridge 8 in the width direction, and has a main body 70 which extends in a direction orthogonal to the supporting shaft 60. One end of the main body 70 serves as an operating portion 71 rotatably supported by the supporting shaft 60. The other end of the main body 70 is bent outward in the width direction, protrudes outward in the width direction, and the protruding portion serves as an input portion 72. Additionally, a middle portion of the main body 70 is placed between two regulating bosses 63. The middle portion of the main body 70 is formed with a boss 73 (as an example of an abutting portion) which protrudes outward in the width direction.

(3) Mounting of Developing Cartridge to Drum Unit (3-1) Pressing Mechanism

Figure 10:
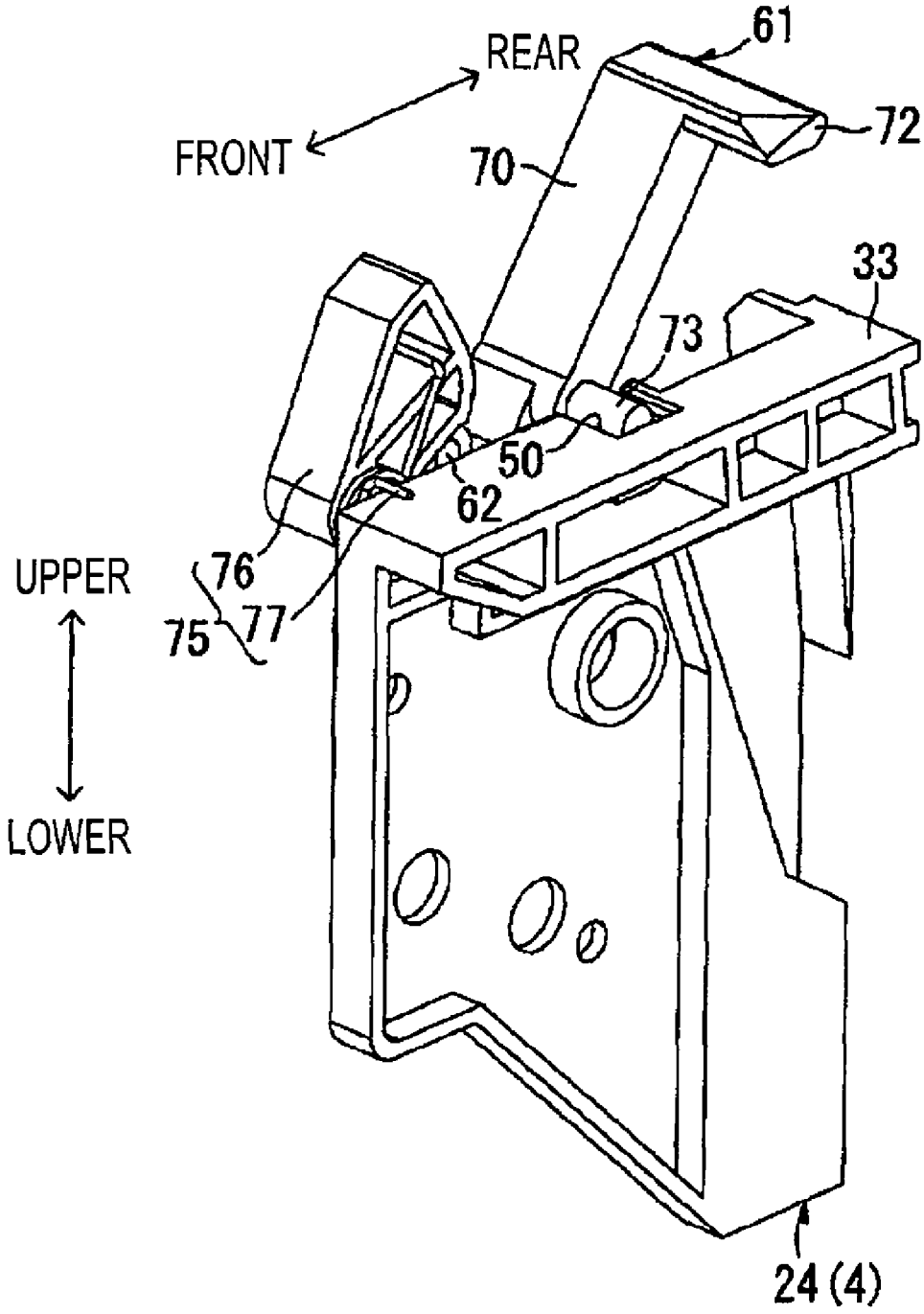
FIG. 10 is a perspective view of a part of the drum unit, in which a developing cartridge is mounted, wherein portions other than a movable member and a developing pressed boss of a developing cartridge are omitted.

Referring to FIG. 10, a pressing mechanism 75 corresponding to each developing pressed boss 62 is provided in each second side plate 24 of the drum unit 4 in a state where the developing cartridge 8 is mounted in the drum unit 4. Each pressing mechanism 75 includes a pressing cam 76 (as an example of a pressing member), and a pressing spring 77 (as an example of a spring) which resiliently presses the pressing cam 76 against the developing pressed boss 62.

The pressing cam 76 has a substantially triangular plate shape in side view. A second supporting shaft 39 (refer to FIGS. 6B and 7A) of the second side plate 24 is inserted through one corner of the pressing cam 76, and is rotatably supported by the second supporting shaft 39. The pressing cam 76 is provided in such a posture that the pressing cam extends obliquely towards the upper rear side from one corner supported by the supporting shaft 39.

The pressing spring 77 is wound around the second supporting shaft 39 (refer to FIGS. 6B and 7A), and has one end locked to the flange portion 33 of the second side plate 24 and the other end locked to the pressing cam 76. Thereby, the pressing cam 76 has a distal end biased towards the lower rear side, and abuts on the developing pressed boss 62 from the upper front side, and biases the developing pressed boss 62 downward, in a state where the developing cartridge 8 is mounted in the drum unit 4.

(3-2) Mounting Process of Developing Cartridge

Figure 11:
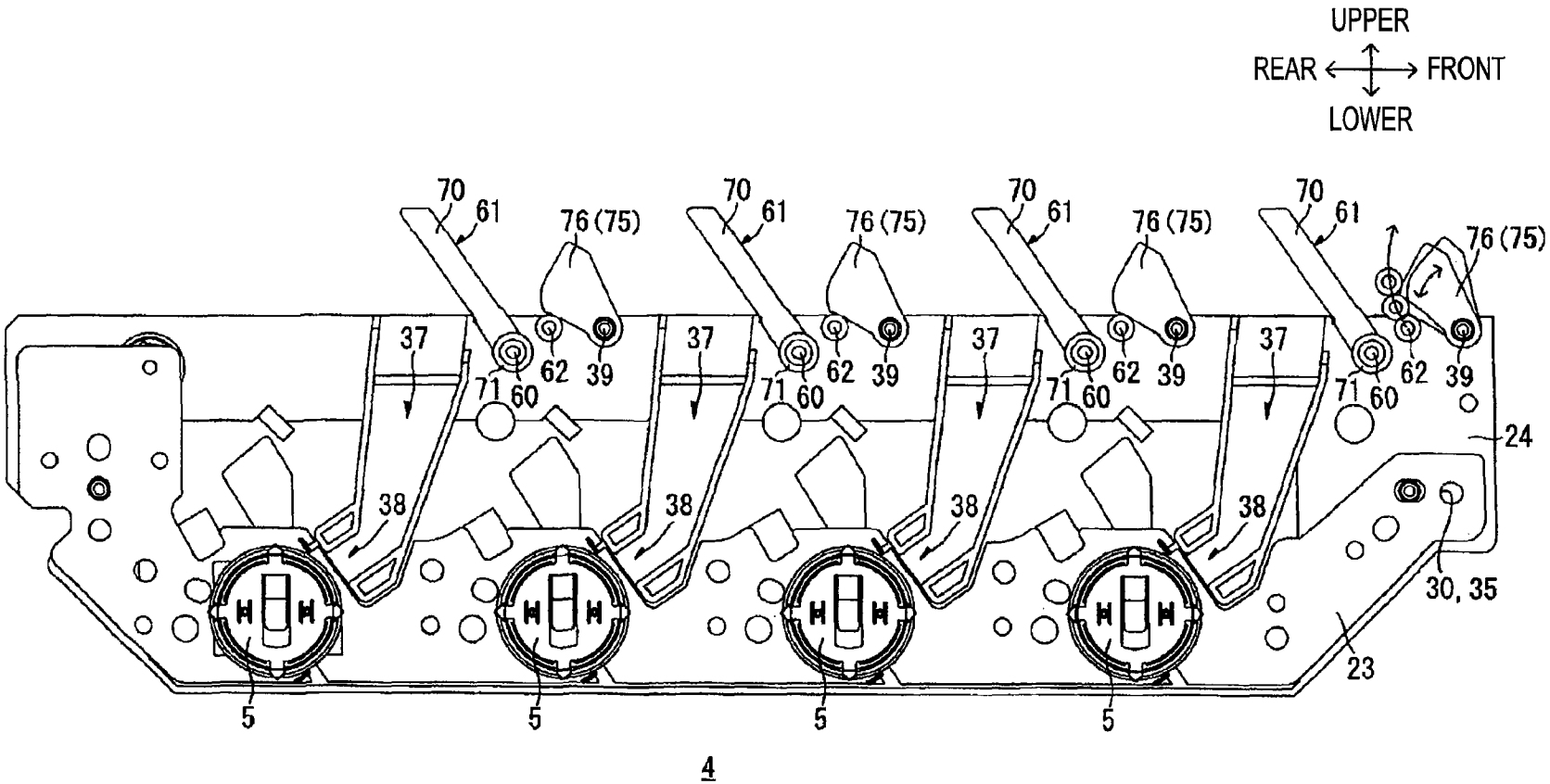
FIG. 11 is a partial sectional view when the drum unit is seen from the left.
Figure 12:
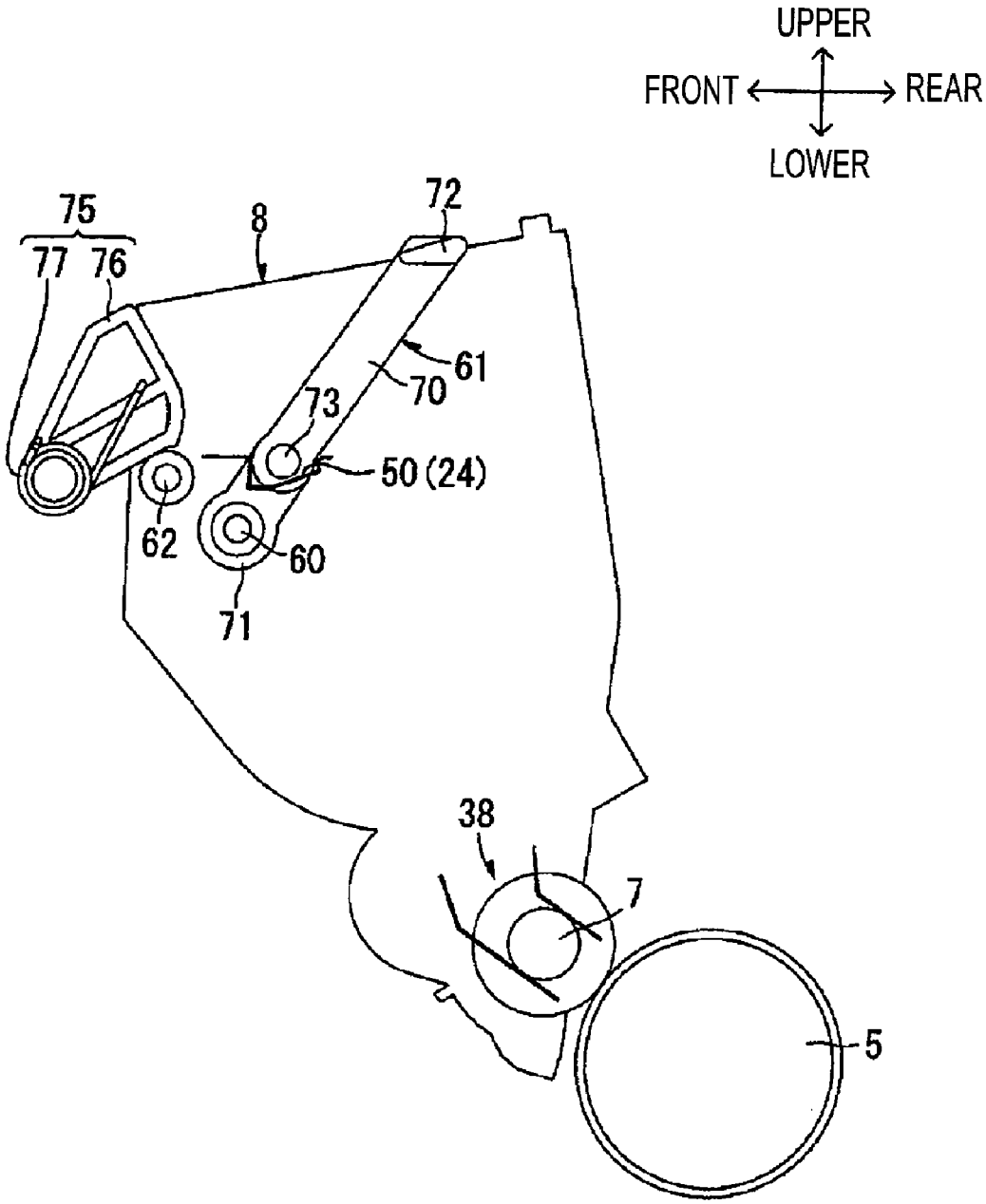
FIG. 12 is a schematic side view showing the positional relationship among a developing cartridge, a photosensitive drum and a pressing mechanism in a state where the developing cartridge is mounted in the drum unit.

The developing cartridge 8 for each color, as shown in FIG. 3, is mounted between the right and left second side plates 24 from above. At this time, both ends of the roller shaft 59 which protrude from both the side walls 55 of the developing frame 51 of the developing cartridge 8 are introduced into the cartridge guide portions 37 from above. Then, the developing cartridge 8 is moved downward while both ends of the roller shaft 59 are guided to the cartridge guide portions 37. When the developing cartridge 8 is guided to the cartridge holding portion 38 (refer to FIGS. 6B and 7A), and as shown in FIG. 12, the developing roller 7 contacts the photosensitive drum 5, further push-in of the development cartridge 8 is regulated, and the developing roller 7 is positioned with respect to the photosensitive drum 5. Thereafter, the developing cartridge 8 slightly inclines to the front side. Thereby, as shown in FIG. 11, the developing pressed boss 62 of the developing cartridge 8 passes between the pressing cam 76 and the operating portion 71 of the movable member 61, and is arranged below the pressing cam 76, thereby lifting the pressing cam 76 against a biasing force caused by the pressing spring 77 (refer to FIG. 12) from below. As a result, the developing pressed boss 62 is biased downward by the pressing cam 76, and the developing cartridge 8 is pressed downward. In this state, as shown in FIG. 12, the boss 73 of the movable member 61 enters the abutting groove 50 of the second side plate 24, and is arranged in the position slightly apart from the bottom face of the abutting groove 50.

4. Internal Structure of Body Casing

A pair of body side plates 81 which opposes each other at a distance from each other in the width direction is provided within the body casing 2. In FIGS. 13 to 16, only the right body side plate 81 is shown.

The front end of the body side plate 81 is provided with a roller member 82 which abuts on the flange portion 33 of each second side plate 24 of the drum unit 4 from below, and slidably guides the drum unit 4 to the inside of the body casing 2. The roller member 82 is rotatably supported by a roller shaft (not shown) which extends inward in the width direction from the body side plate 81.

Additionally, one body reference shaft 83 is provided to extend between the rear ends of the right and left body side plates 81. When the drum unit 4 is mounted into the body casing 2, first, the front cover 3 (refer to FIG. 1) of the body casing 2 is opened. Then, the rear end edge of the flange portion 33 of the second side plates 24 of the drum unit 4 is abutted on the roller member 82 from above. Then, by moving the drum unit 4 rearward, the flange portion 33 of the second side plate 24 slides on the roller member 82, and the drum unit 4 is guided into the body casing 2. As the roller member 82 abuts the inclined surface 34 (refer to FIGS. 6A to 7B) provided on the front side of the flange portion 33, when the cutout portion 31 of the first side plate 23 abuts the body reference shaft 83 from the upper front side after the drum unit 4 has moved downward as a whole, and both the ends of the supporting shaft 25 press groove portions 130 provided in the body side plates 81 towards the lower rear side, further push-in of the drum unit 4 is regulated. Thereby, the mounting of the drum unit 4 into the body casing 2 is completed.

The detachment of the drum unit 4 from the body casing 2 becomes reverse to one described above.

5. Separating Mechanism

A separation mechanism 91 is provided within the body casing 2. The separating mechanism 91 is configured to displace each developing cartridge 8 to a first position where each developing cartridge contacts the corresponding photosensitive drum 5 and a second position where each developing cartridge is separated from the corresponding photosensitive drum 5.

The separating mechanism 91 includes translation cams 92 (as an example of a translation member), rails 93 which hold the translation cams 92, respectively, so as to be linearly movable in the front-rear direction, and synchronous moving mechanism 94 for synchronously linearly moving the translation cams 92.

(1) Translation Cam

Figure 14:
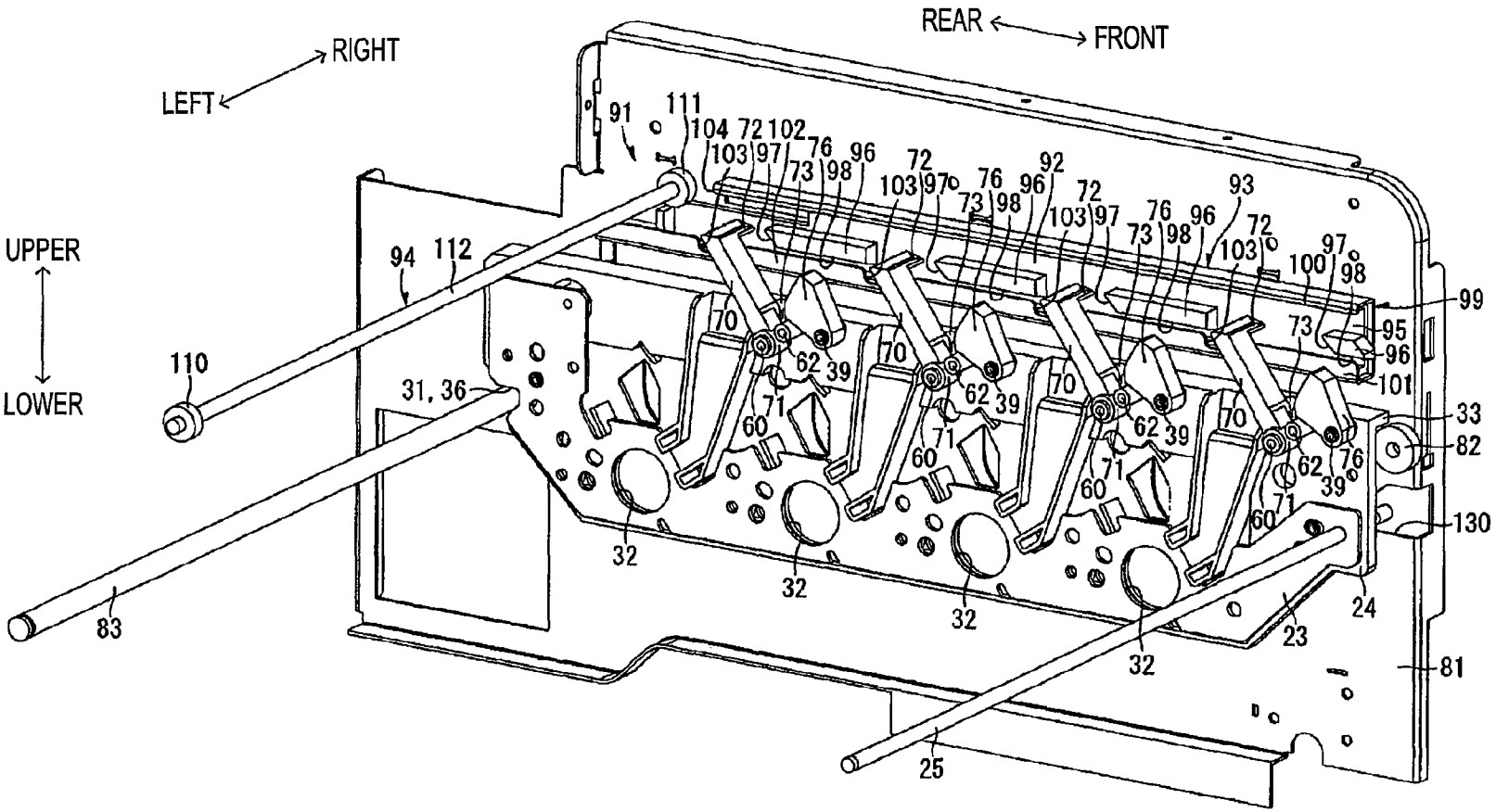
FIG. 14 is a perspective view showing a state where all developing cartridges press-contact the photosensitive drums.
Figure 15:
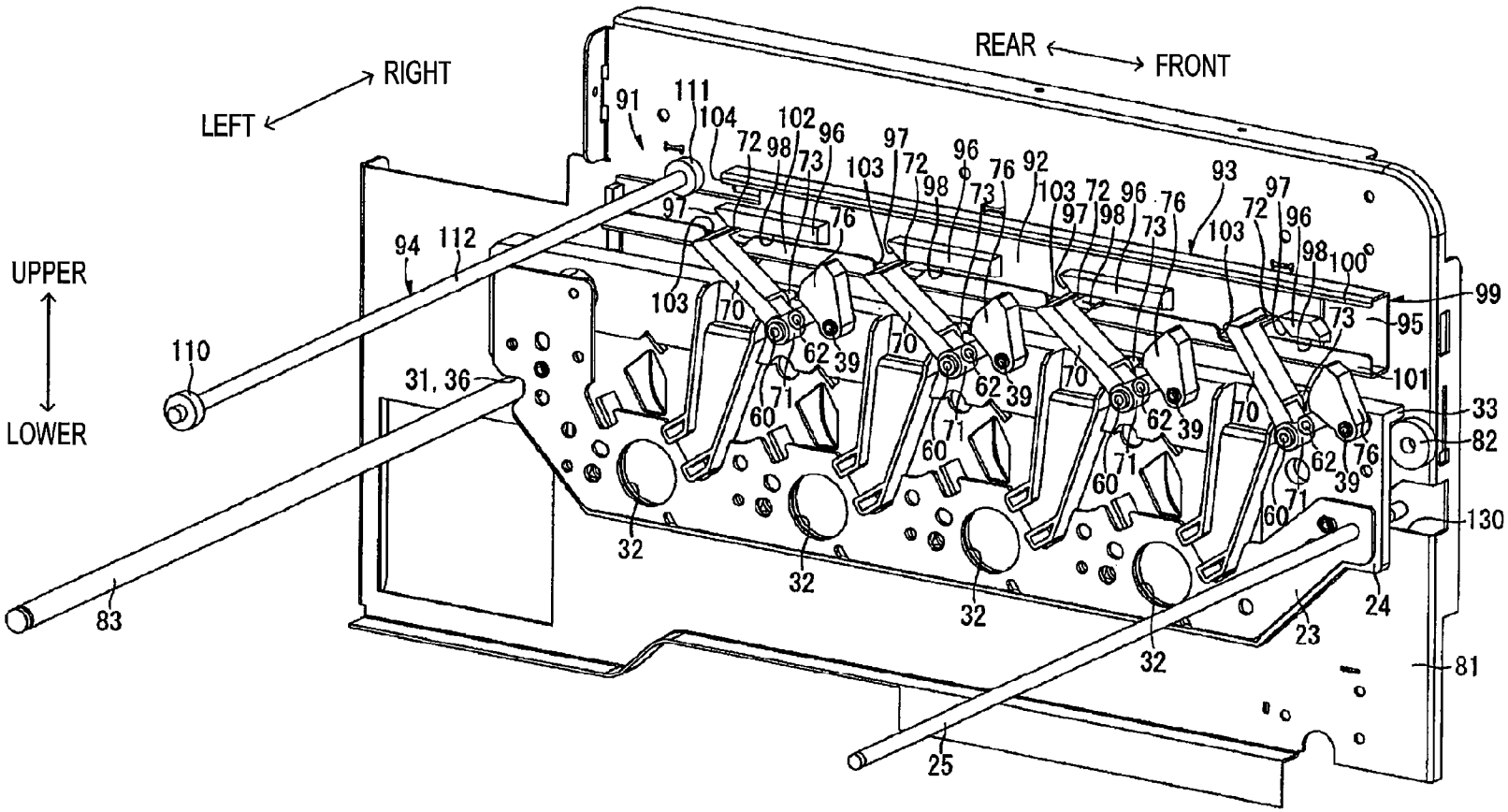
FIG. 15 is a perspective view showing a state where only a developing cartridge for black press-contacts a photosensitive drum.
Figure 17:
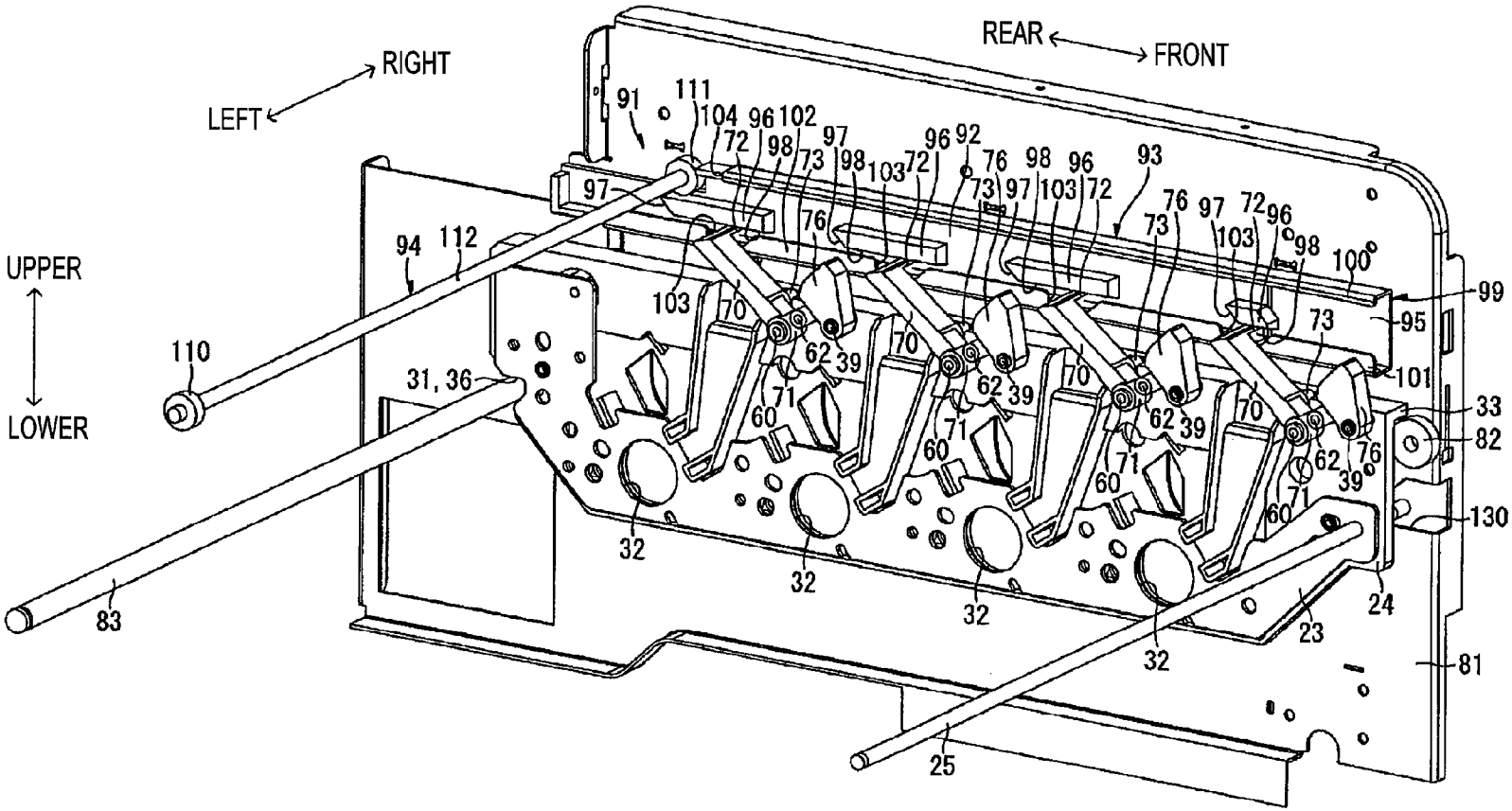
FIG. 17 is a perspective view showing a state where all developing cartridges are separated from photosensitive drums.

The translation cams 92 are provided on both sides in the right-left direction within the body casing 2. Only the right translation cam 92 is shown in FIGS. 14, 15, and 17. Since the right and left translation cams 92 have the same construction, only the right translation cam 92 will be described below.

The translation cam 92 integrally includes a main body 95, and four cam portions 96 provided on the internal surface of the main body 95.

Figure 13:
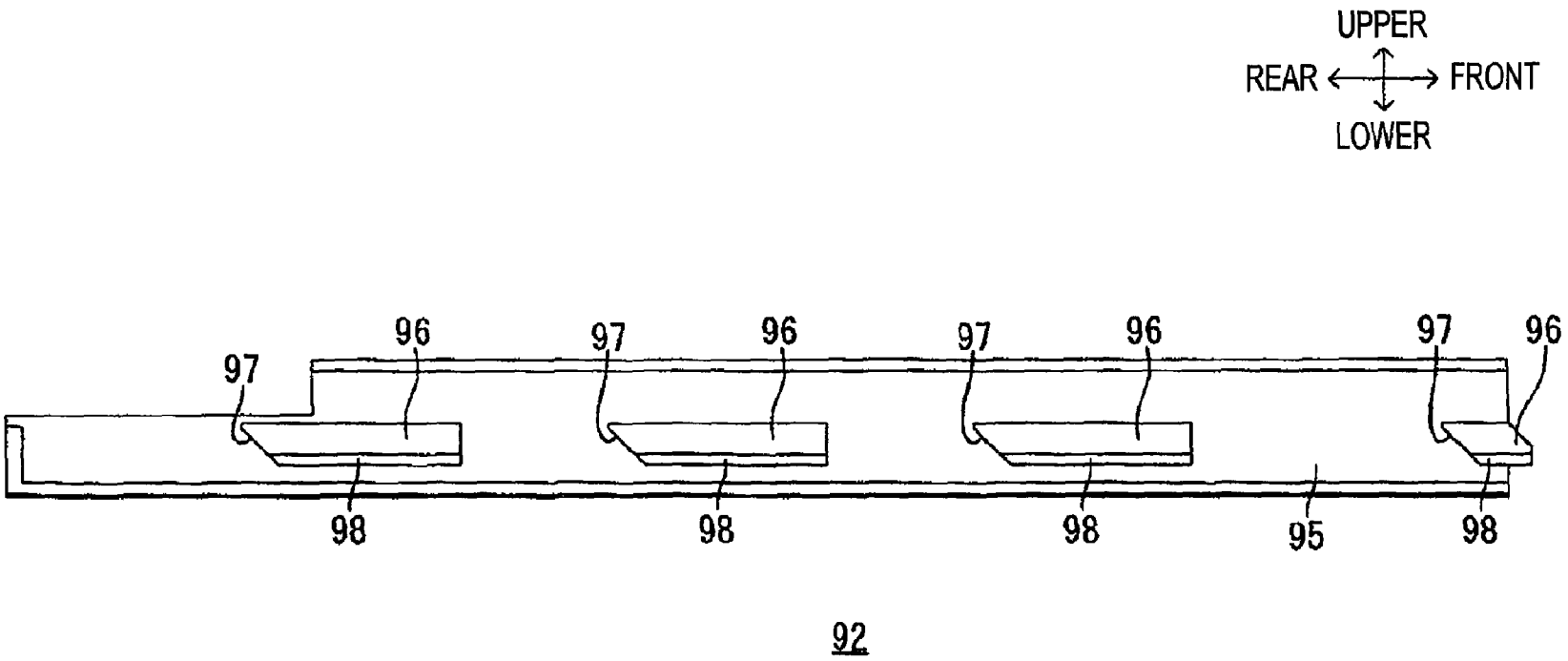
FIG. 13 is a side view of a translation cam.

As shown in FIG. 13, the main body 95 has a substantially elongated rectangular shape which extends in the front-rear direction, and the rear end thereof is cut out in a rectangular shape in side view from the upper face. The main body 95 has a substantially U-shape section, and the upper end edge and lower end edge thereof are bent inward in the width direction.

The four cam portions 96 are provided corresponding to the developing cartridges 8 (refer to FIG. 3) for respective colors. The cam portions 96 protrude inward in the width direction at predetermined intervals on the internal surface of the main body 95, and have a substantially rectangular shape in side view. The rear end of each cam portion 96 forms a first inclined surface 97 which inclines towards the upper rear side from the lower end edge thereof. Moreover, the lower end of the cam portion 96 forms a second inclined surface 98 (as an example of an inclined surface) which inclines inwardly in the width direction and upwardly from the main body 95 side.

Three rear cam portions (three cam portions 96 other than the frontmost cam portion 96) are formed so that the interval between the cam portions 96 which are adjacent to each other becomes equal. The frontmost cam portion 96 is provided so that the interval from the cam portion 96 which is adjacent to the frontmost cam portion becomes larger than the interval between the three rear cam portions 96.

(2) Rail

The rails 93 are provided on both sides in the right-left direction within the body casing 2. Since the right and left rails 93 have the same construction, the right rail 93 will be described below.

As shown in FIG. 14, the rail 93 includes a main body 99 which is fixed to the body side plate 81, extends in the front-rear direction, and has a substantially rectangular shape in side view, a first flange portion 100 which extends inward in the width direction inside from the upper end edge of the main body 99, and a second flange portion 101 which extends inward in the width direction from the lower end edge of the main body 99.

The second flange portion 101 has a stopper 102 which further extends towards the upper side from the side end edge thereof in the width direction. A middle portion of the stopper 102 in the front-rear direction is formed with four recesses 103 having a shape which is cut out from the upper end thereof.

The rear ends of the main body 99 and the first flange portion 100 are formed with a cutout portion 104 which is cut out in a rectangular shape in side view from the upper face. The translation cam 92 is arranged on the second flange portion 101 so that the cam portion 96 protrudes inward in the width direction. The translation cam 92 is slidably provided along the rail 93, and the rear end of the translation cam 92 is always exposed upward from the cutout portion 104 irrespective of the position of the translation cam 92.

(3) Synchronous Moving Mechanism

The synchronous moving mechanism 94 is adapted to transmit the driving force for linear movement to the right translation cam 92 from the left translation cam 92, for example.

Specifically, the synchronous moving mechanism 94 includes a left rack gear (not shown) which is formed on the upper face of the rear end of the left translation cam 92, a left pinion gear 110 which meshes with the left rack gear, a right rack gear (not shown) which is formed on the upper face of the rear end of the right translation cam 92 and a right pinion gear 111 which meshes with this right rack gear, and a connecting shaft 112 to which the left pinion gear 110 and the right pinion gear 111 are attached to be non-rotatable with each other. The driving force is input to the left translation cam 92 from a motor (not shown).

(4) Separating/Pressing Operation

The operation of the separating mechanism 91 will be described with reference to FIGS. 14 to 17. As shown in FIG. 14, in a state where the drum unit 4 is mounted into the body casing 2, and the translation cam 92 is moved to the frontmost position, the first inclined surface 97 of each cam portion 96 and the input portion 72 of the movable member 61 arranged behind the inclined surface 97 face each other in a non-contact state with an interval therebetween in the front-rear direction. The interval between the first inclined surface 97 of the frontmost cam portion 96 and the input portion 72 of the movable member arranged behind the inclined surface corresponding thereto is larger than the interval between the first inclined surface 97 of each of the three rear cam portions 96 and the input portion 72 of the movable member 61 arranged behind the inclined surface corresponding thereto.

In this state, each developing cartridge 8 is arranged in a contact position where the developing roller 7 and the photosensitive drum 5 contact with each other. Also, each pressing cam 76 abuts the developing pressed boss 62 of each developing cartridge 8 from above, and presses each developing pressed boss 62 downward.

When the driving force of the motor (not shown) is input to an input rack gear (not shown) of the left translation cam 92 and the left translation cam 92 is moved rearward from this state, the left pinion gear 110 rotates with the movement of the left translation cam 92, the rotation of the left pinion gear 110 is transmitted to the right pinion gear 111 via the connecting shaft 112 and the right pinion gear 111 rotates in the same direction as the left pinion gear 110 whereby the right translation cam 92 moves rearward.

Figure 16:
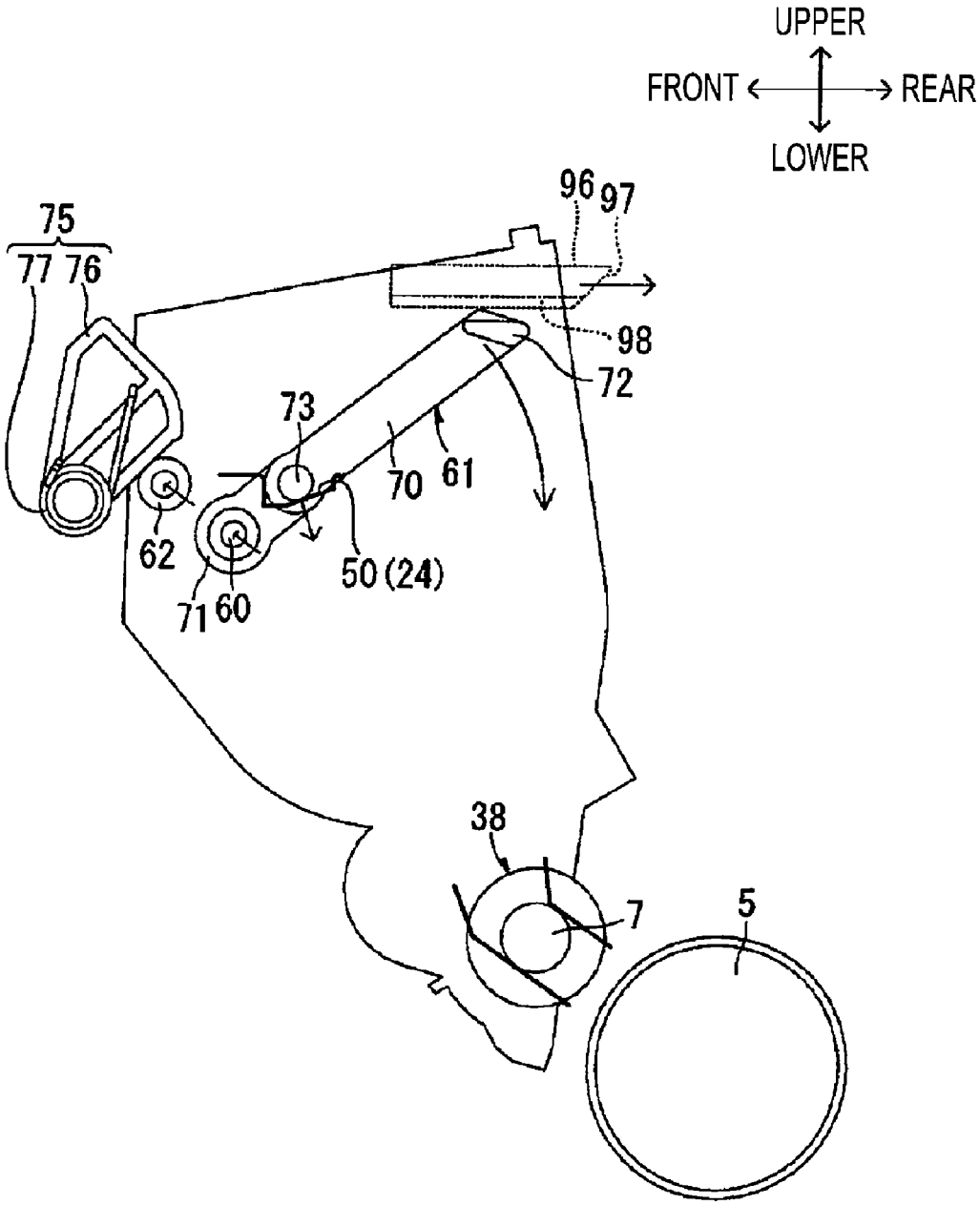
FIG. 16 is a schematic side view showing the positional relationship among a developing cartridge, a photosensitive drum and a pressing mechanism in a state where a developing cartridge is separated from a photosensitive drum.

When the rearward movement of the translation cam 92 proceeds, the first inclined surface 97 of each of the three rear cam portions 96 abuts on the input portion 72 of the movable member 61 arranged below and behind the inclined surface, thereby pressing the input portion 72 of each of the three rear movable members 61 towards the lower rear side. Accordingly, each movable member 61 rotates towards the lower rear side about the supporting shaft 60. As shown in FIG. 16, the boss 73 of each movable member 61 abuts the bottom face of the abutting groove 50 of the second side plate 24 from above during the rotation of the movable member 61. At this time, a force having a rearward and downward component force is applied to the abutting groove 50.

When the rearward movement of the translation cam 92 proceeds and the input portion 72 of the movable member 61 moves forward with respect to the first inclined surface 97 of the cam portion 96, the movable member 61 rotates with the boss 73 as a fulcrum. That is, the operating portion 71 is lifted towards the upper front side with the rearward and downward movement of the input portion 72. Consequently, a pressing force which is directed forward and upward is applied to the developing cartridge 8 via the supporting shaft 60 which rotatably supports the operating portion 71. This causes the developing cartridges 8 corresponding to yellow, magenta, and cyan colors, respectively, to be lifted against a pressing force applied from the pressing cam 76.

Then, when the rearward movement of the translation cam 92 proceeds further, and as shown in FIG. 15, the input portion 72 of the movable member 61 abuts the second inclined surface 98 of each of the three rear cam portions 96, the developing cartridges 8 corresponding to yellow, magenta, and cyan colors, respectively, are arranged in the second position, and the developing roller 7 of each developing cartridge 8 is separated from the photosensitive drum 5. At this time, the developing pressed boss 62 of the developing cartridge 8 for black is pressed by the pressing cam 76. This causes only the developing roller 7 of the developing cartridge 8 for black to be pressed against the photosensitive drum 5. Additionally, the input portions 72 of the three rear movable members 61 enter the recesses 103 of the rail 93. The second inclined surface 98 inclines inwardly upward in the width direction from the main body 95 side. Therefore, the pressing force applied to the input portion 72 of the movable member 61 from the second inclined surface 98 of the cam portion 96 includes a force component in a direction which is directed inward in the width direction. As a result, the developing cartridge 8 can be positioned in the width direction.

Thereafter, when the rearward movement of the translation cam 92 proceeds further, the first inclined surface 97 of the frontmost cam portion 96 abuts the input portion 72 of the movable member 61 arranged behind the inclined surface, thereby pressing one end of the frontmost movable member 61 towards the lower rear side. Accordingly, the movable member 61 rotates rearward about the supporting shaft 60. As shown in FIG. 16, the boss 73 of the movable member 61 abuts the bottom face of the abutting groove 50 of the second side plate 24 from above during the rotation of the movable member 61.

When the rearward movement of the translation cam 92 proceeds and the input portion 72 of the movable member 61 moves forward with respect to the first inclined surface 97 of the cam portion 96, the movable member 61 rotates with the boss 73 as a fulcrum. That is, the operating portion 71 is lifted upward with the downward movement of the input portion 72. Consequently, a pressing force which is directed forward is applied to the developing cartridge 8 via the supporting shaft 60 which rotatably supports the operating portion 71. This causes the developing cartridge 8 for black to be lifted upward against a pressing force applied from the pressing cam 76.

Then, when the rearward movement of the translation cam 92 proceeds further, and as shown in FIG. 17, the input portion 72 of the movable member 61 abuts the second inclined surface 98 of the frontmost cam portion 96, the developing cartridge 8 for black is arranged in the second position, and the developing roller 7 of the developing cartridge 8 for black is separated from the photosensitive drum 5. This causes the developing rollers 7 of all the developing cartridges 8 to be separated from the photosensitive drums 5, respectively.

Additionally, at this time, the input portion 72 of the frontmost movable member 61 enters the recess 103 of the rail 93. Additionally, since the movable member 61 contacts the second inclined surface 98, the developing cartridge 8 is positioned in the width direction by the second inclined surface 98.

The translation cam 92 can be returned to the states shown in FIGS. 14 and 15, respectively, from the state shown in FIG. 17 by moving the translation cam 92 forward. At this time, when the first inclined surface 97 of each cam portion 96 and the input portion 72 of the movable member 61 located behind the inclined surface are separated from each other, the upward force applied to the developing pressed boss 62 from the movable member 61 is released. Then, the developing cartridge 8 is pressed downward by the pressing cam 76, and the developing roller 7 and the photosensitive drum 5 are arranged in a contact position where they contact with each other.

10. Advantages

As described above, the four photosensitive drums 5 are held in the drum unit 4 in a state where the drums are arranged in parallel with each other. The developing cartridges 8 which hold the developing rollers 7, respectively, are detachably mounted in the drum unit 4. Each developing cartridge 8 is provided with the movable member 61. Each movable member 61 is rotatably supported by the supporting shaft 60 provided in the developing cartridge 8. The drum unit 4 is movably mounted into the body casing 2 along the front-rear direction. The translation cam 92 is provided within the body casing 2 so as to be linearly movable in the front-rear direction.

The boss 73 of the movable member 61 abuts the drum unit 4 during the rotation of the movable member 61. In other words, the movable member 61 and the drum unit 4 do not abut each other immediately after a pressing force is input to the input portion 72 of the movable member 61 from the translation cam 92 by the movement of the translation cam 92. Accordingly, a force in the movement direction (front-rear direction) of the translation cam 92 is not applied to the drum unit 4. Then, when the pressing force is input to the input portion 72 of the movable member 61 from the translation cam 92, the movable member 61 is rotated about the supporting shaft 60. Thereby, the force in the movement direction (front-rear direction) of the translation cam 92 is converted into the force in the rotational direction (substantially the upper-lower direction) of the movable member 61. Additionally, since the boss 73 presses the abutting groove 50 towards the rear lower side, the force that the drum unit 4 receives after the abutment coincides with the positioning direction of the drum unit 4, and the position of the drum unit 4 does not deviate.

Then, when the movable member 61 is further rotated by the further linear movement of the translation cam 92, a force is applied to a developing cartridge 8 from the operating portion 71 of the movable member 61, and the developing cartridge 8 is moved from the first position where the developing roller 7 contacts the photosensitive drum 5 to the second position where the developing roller 7 is separated from the photosensitive drum 5. This enables the developing roller 7 to be separated from the photosensitive drum 5.

When the developing roller 7 is separated from the photosensitive drum 5 in this way, the drum unit 4 can be prevented from deviating with respect to the body casing 2.

The movable member 61 has the main body 70 which extends in the direction orthogonal to the supporting shaft 60. The supporting shaft 60 rotatably supports one longitudinal end of the main body 70. The input portion 72 is provided at the other longitudinal end of the main body 70, and the boss 73 is provided at the longitudinal middle portion of the main body 70.

Thereby, when a pressing force is input to the input portion 72 of the movable member 61 from the translation cam 92 by the linear movement of the translation cam 92, the movable member 61 rotates about the supporting shaft 60 which supports one end thereof. Since the middle portion of the movable member 61 is provided with the boss 73, the boss 73 of the movable member 61 can be made to abut on the drum unit 4 by the rotation of the movable member 61.

The movable member 61 rotates with the boss 73 as a fulcrum by the input of the pressing force to the input portion 72 in a state where the boss 73 has abutted on the drum unit 4. Thereby, one end of the movable member 61 supported by the supporting shaft 60 is moved in a direction (substantially upward) opposite to the rotational direction (substantially downward) of the input portion 72 by the principle of leverage using the boss 73 of the movable member 61 as a fulcrum. Therefore, the developing cartridge 8 is moved in the movement direction of one end of the movable member 61 via the supporting shaft 60. Accordingly, the developing cartridge 8 can be moved from the first position to the second position by a simple construction. Further, since the developing cartridge 8 can be moved to the second position form the first position while pressing the drum unit 4 in the direction opposite to the movement direction of the developing cartridge 8, when the developing roller 7 is separated from the photosensitive drum 5, the position of the drum unit 4 can be prevented from deviating with respect to the body casing 2.

The boss 73 of the movable member 61 protrudes in a direction parallel to the supporting shaft 60 from the main body 70. Thereby, since the rotational axis of the movable member 61 until the boss 73 abuts the drum unit 4, and the rotational axis of the movable member 61 in a state where the boss 73 has abutted on the drum unit 4 can be made parallel to each other, shifting to the rotation of the movable member 61 about the boss 73 from the rotation of the movable member 61 about the supporting shaft 60 can be smoothly made with the movement of the translation cam 92.

The movable member 61 does not contact the drum unit 4 until the pressing force from the translation cam 92 until the pressing force from the translation cam 92 is input and the movable member 61 starts to rotate. Accordingly, it is not necessary to accurately adapt the distance from the nip position between the developing roller 7 and the photosensitive drum 5 to the abutting portion to a state where the developing roller 7 contacts the photosensitive drum 5 by appropriate pressing force.

Additionally, the body casing 2 has the body reference shaft 83 which extends in the width direction. The drum unit 4 abuts the body reference shaft 83 in a state with which the drum unit is mounted into the body casing 2. Accordingly, the drum unit 4 is positioned with respect to the body casing 2. The direction of a pressing force input to the input portion 72 of each movable member 61 from the translation cam 92 is substantially same as the direction (the rearward and downward direction in FIG. 14) in which the drum unit 4 abuts the body reference shaft 83. Therefore, for example, even if a force acts on the drum unit 4 via the movable member 61 from the translation cam 92, the force is a force in the substantially same direction as the direction in which the drum unit 4 abuts the body reference shaft 83. Consequently, when the developing roller 7 is separated from the photosensitive drum 5, the drum unit 4 can be prevented from deviating with respect to the body casing 2.

Additionally, the cam portion 96 for pressing the input portion 72 of the movable member 61 is provided in the translation cam 92 in correspondence with the movable member 61. When the cam portion 96 is abutted on the input portion 72 of the movable member 61, the input portion 72 of the movable member 61 is pressed by the cam portion 96. On the other hand, when the cam portion 96 is separated from the input portion 72 of the movable member 61, the pressing of the input portion 72 of the movable member 61 by the cam portion 96 is released. Therefore, by the simple construction in which the translation cam 92 is provided with the cam portion 96, the movable member 61 can be rotated and the developing roller 7 can be separated from the photosensitive drum 5.

Additionally, the linear movement of the translation cam 92 allows switching to a first state where all the cam portions 96 abut the input portions 72 of the movable members 61, respectively, a second state where the cam portion 96 corresponding to the developing cartridge 8 for black abuts the input portion 72 of the movable member 61, and the other cam portions 96 are separated from the input portions 72 of the movable members 61, and a third state where all the cam portions 96 are separated from the input portions 72 of the movable members 61, respectively.

Additionally, the developing cartridges 8 are provided corresponding to black, yellow, magenta, and cyan colors, respectively. In the first state, as the cam portions 96 abut the input portions 72 of the movable members 61 for all the colors, the developing rollers 7 for all the colors are separated from the photosensitive drums 5. In the second state, as the cam portions 96 abut the input portions 72 of the movable members 61 corresponding to yellow, magenta, and cyan, respectively, the developing rollers 7 for yellow, magenta, and cyan are separated from the photosensitive drums 5, and the developing roller 7 for black contacts the photosensitive drum 5. In the third state, as the cam portions 96 are separated from the input portions 72 of the movable members 61 for all the colors, the developing rollers 7 for all the colors contact the photosensitive drums 5. Therefore, the wear of the developing rollers 7 for yellow, magenta, and cyan can be prevented by performing switching to the second state when a monochrome image is formed.

Additionally, the surface of abutment of the cam portion 96 onto the input portion 72 of the movable member 61 is formed on the second inclined surface 98 which inclines with respect to the axial direction of the photosensitive drum 5. Therefore, the pressing force applied to the input portion 72 of the movable member 61 from the cam portion 96 includes a force component in the axial direction (width direction) of the photosensitive drum 5. As a result, since the force in the width direction acts on the drum unit 4, the drum unit 4 can be positioned in the width direction.

Additionally, the pressing mechanism 75 for pressing the developing cartridge 8 in a direction in which the developing roller 7 and the photosensitive drum 5 oppose each other is provided corresponding to each developing cartridge 8. The developing roller 7 can be pressed against the photosensitive drum 5 by the pressing mechanism 75. Accordingly, toner can be fully supplied to the photosensitive drum 5 from the developing roller 7.

Additionally, the second supporting shaft 39 is provided in the drum unit 4 so as to protrude therefrom. The pressing cam 76 is rotatably supported by the second supporting shaft 39, and the pressing cam is resiliently pressed against the developing pressed boss 62 of the developing cartridge 8 by the spring 77. The developing roller 7 can be pressed against the photosensitive drum 5 by this pressing.

Additionally, the movable members 61 are provided on right and left sides of the developing cartridge 8. Thereby, when the movable member 61 has been rotated by the linear movement of the translation cam 92, the force in the direction which is directed to the second position from the first position can be uniformly applied to the developing cartridge 8. As a result, the developing cartridge 8 can be moved to the second position from the first position without any inclination of the posture of the developing cartridge 8 with respect to the axial direction of the developing roller 7.

Additionally, the movable member 61 is arranged in order of the operating portion 71, the boss 73, and the input portion 72 from the developing roller 7 side in the direction in which the developing roller 7 and the photosensitive drum 5 oppose each other. Accordingly, since the operating portion 71 of the movable member 61 is arranged in the position closest to the developing roller 7, the distance of the developing roller 7 apart from the photosensitive drum 5 can be kept accurately constant as compared with a construction in which the operating portion 71 is arranged in a position distant from the developing roller 7.

11. Other Exemplary Embodiments

While the present invention has been shown and described with reference to certain exemplary embodiments thereof, it will be understood by those skilled in the art that various changes in form and details may be made therein without departing from the spirit and scope of the invention as defined by the appended claims.

Figure 18:
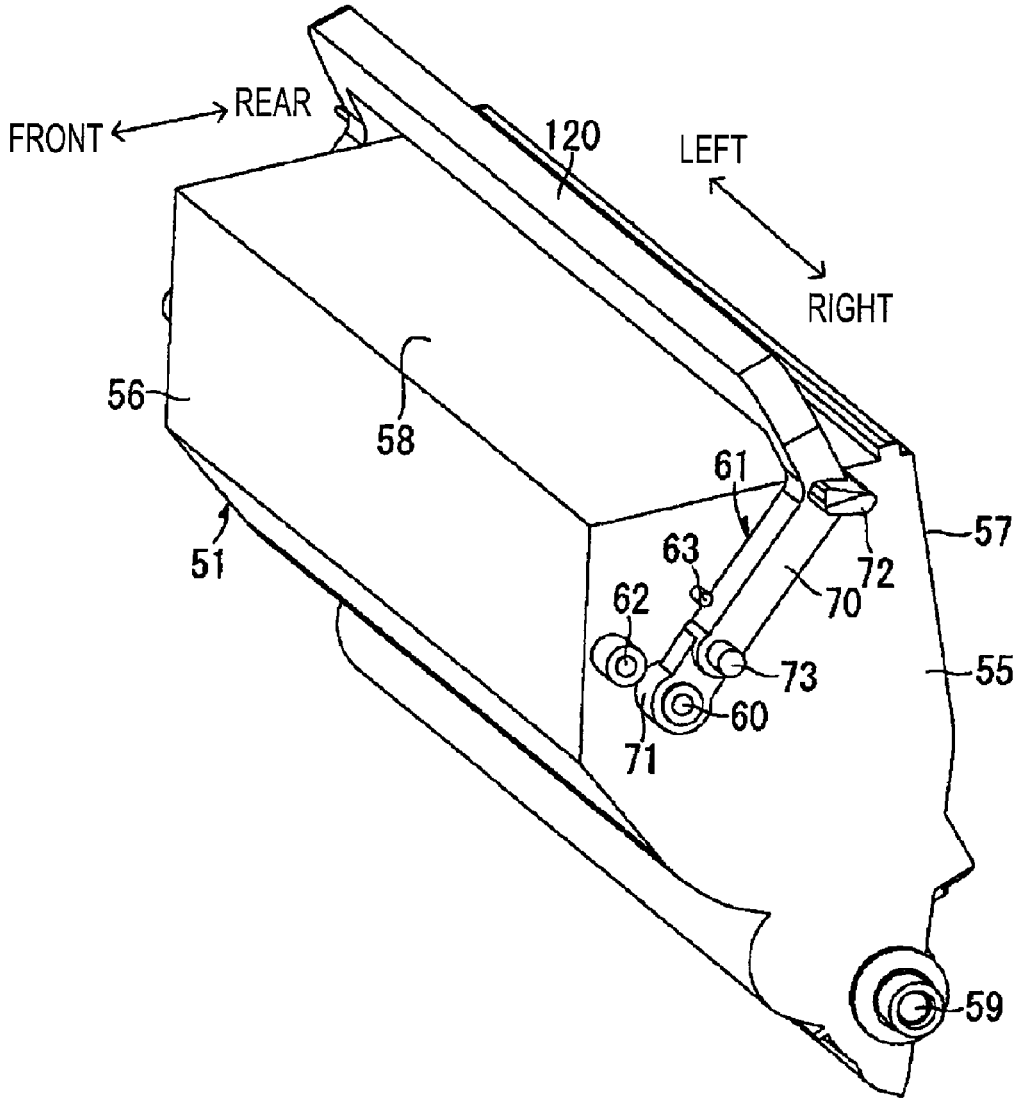
FIG. 18 is a perspective view seen from the upper front right side of a developing cartridge according to another exemplary embodiment of the present invention, which is in a first position.
Figure 19:
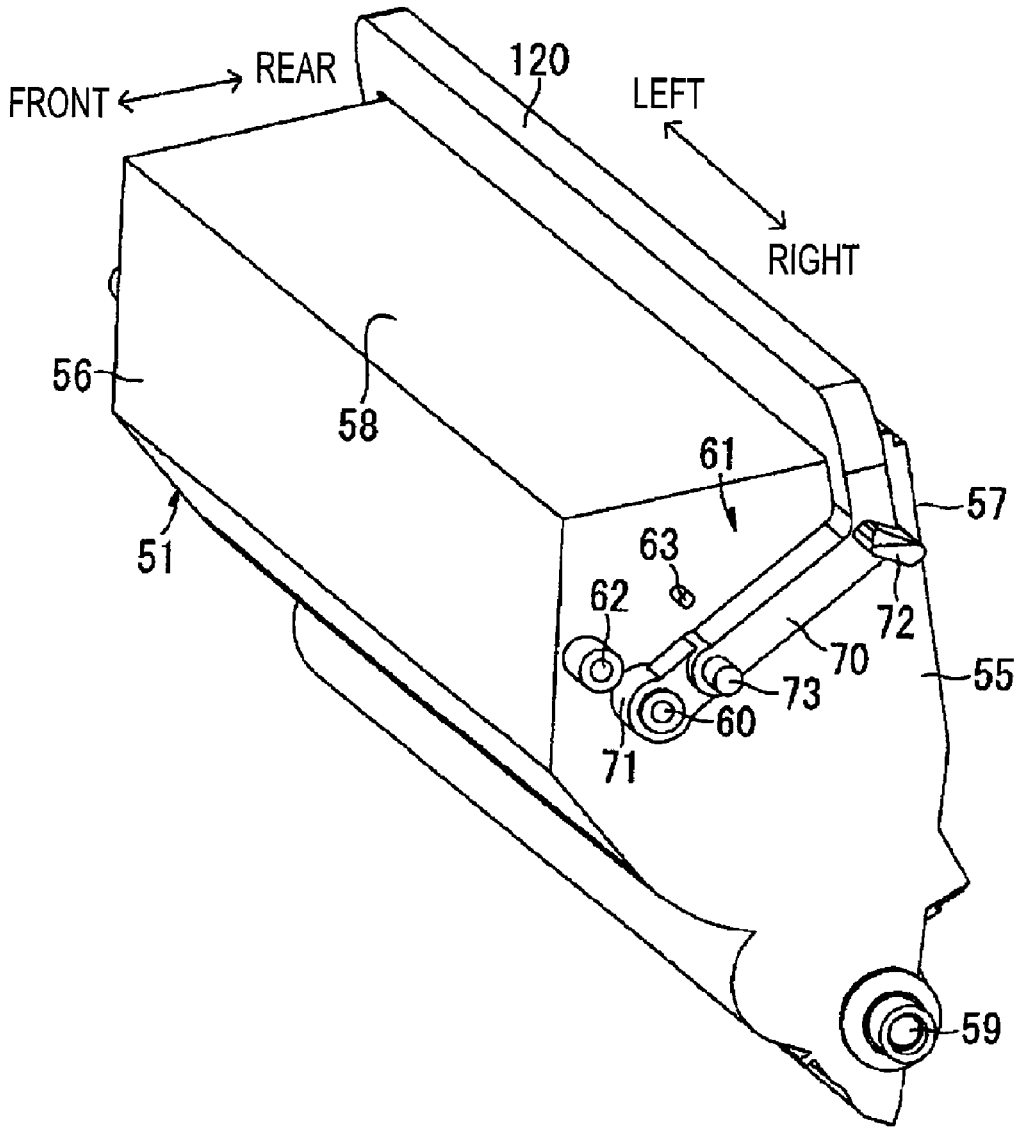
FIG. 19 is a perspective view seen from the upper front right side of a developing cartridge according to another exemplary embodiment of the present invention, which is in a second position.

In the above-described exemplary embodiment, as shown in FIGS. 8 and 9, the construction in which the movable members 61 is provided on both sides of the developing cartridge 8 in the width direction has been exemplified. However, as shown in FIGS. 18 and 19, the upper ends (input portions 72) of the pair of right and left movable members 61 may be connected together by a connecting portion 120. In this case, the connecting portion 120 is formed in a substantial U-shape in front view, and the free ends thereof are respectively connected with the input portions 72 of the right and left movable members 61. Additionally, the middle portion of the connecting portion 120 is arranged above the upper wall 58 of the developing frame 51. Thereby, the connecting portion 120 can be gripped and the developing cartridge 8 can be operated (mounting/detaching operation to/from the drum unit 4, and the like). Additionally, the pair of right and left movable members 61 and the connecting portion 120 can be integrally formed by resin molding.

In the above-described exemplary embodiment, a color laser printer has been exemplified. However, the present invention is not limited thereto. The printer 1 may be a monochrome laser printer which has a single developing cartridge 8 for black.

What is claimed is:

1. An image forming apparatus comprising:

an apparatus body;

a tandem photosensitive drum unit which holds a plurality of photosensitive drums to be in parallel with each other, and is movably mounted in the apparatus body along an array direction of the photosensitive drums;

a developing cartridge which is provided for each of the photosensitive drums, supports a developing roller for supplying developer to the corresponding photosensitive drum, and is configured to be detachably mounted in the tandem photosensitive drum unit;

a translation member which is provided in the apparatus body to be movable linearly in the array direction;

a supporting shaft which is provided on each of the developing cartridges; and a movable member which is rotatably supported by the supporting shaft, and provided at a position where the translation member abuts along a linear movement thereof, wherein the movable member includes:

a main body which extends in a direction orthogonal to the supporting shaft, and is rotatably supported by the supporting shaft at a first end portion of the main body in a longitudinal direction thereof;

an input portion which is provided at a second end portion of the main body opposite to the first end portion, and to which a pressing force is input by the translation member with the linear movement of the translation member after abutting the input portion;

an abutting portion which is provided at a middle portion between the first and second end portions of the main body, and abuts the tandem photosensitive drum unit while the movable member rotates about the supporting shaft by the input of the pressing force to the input portion; and an operating portion which is configured to apply a force to the supporting shaft for moving the developing cartridge from a first position where the developing roller contacts the photosensitive drum to a second position where the developing roller is separated from the photosensitive drum as the movable member is rotated with the abutting portion as a fulcrum by the input of the pressing force to the input portion while the abutting portion abuts the tandem photosensitive drum unit.

2. The image forming apparatus according to claim 1, wherein the abutting portion includes a boss which protrudes from the main body of the movable member in a direction parallel to the supporting shaft.

3. The image forming apparatus according to claim 1, wherein the apparatus body includes a body reference shaft which extends in an axial direction of the photosensitive drum, wherein the tandem photosensitive drum unit abuts the body reference shaft in a state where the tandem photosensitive drum unit is mounted in the apparatus body, and wherein a direction in which the tandem photosensitive drum unit abuts the body reference shaft is substantially same as a direction of the pressing force input to the input portion of the movable member from the translation member.

4. The image forming apparatus according to claim 1, wherein the translation member includes a cam portion which is provided for each of the movable members, and abuts the input portion of the corresponding movable member to press the input portion.

5. The image forming apparatus according to claim 4, wherein the cam portions are arranged so as to take a first state where all the cam portions abut the input portions of the movable members, respectively, a second state where at least one of the cam portions abuts the input portion of the corresponding movable member, and a third state where all the cam portions are separated from the input portions of the movable members, respectively, according to the linear movement of the translation member.

6. The image forming apparatus according to claim 5, wherein the developing cartridges correspond to colors of black, yellow, magenta, and cyan, respectively, and wherein in the second state, one of the cam portions corresponding to the input portion of the movable member for the black is separated therefrom, and the others of the cam portions corresponding to the input portions of the movable members for the yellow, magenta, and cyan abut thereon.

7. The image forming apparatus according to claim 4, wherein each of the cam portions has an inclined surface configured to abut the input portion of the corresponding movable member, the inclined surface being inclined with respect to an axial direction of the photosensitive drum.

8. The image forming apparatus according to claim 1, further comprising:

a pressing mechanism which is provided for each of the developing cartridges to press the corresponding developing cartridge in a direction in which the developing roller and the photosensitive drum oppose each other in a state where the developing cartridge is mounted in the tandem photosensitive drum unit.

9. The image forming apparatus according to claim 8, wherein each of the pressing mechanisms is rotatably supported by a second supporting shaft provided in the tandem photosensitive drum unit, and wherein each of the pressing mechanisms includes:

a pressing member which abuts a pressed portion provided in the corresponding developing cartridge, and a spring which resiliently presses the pressing member to the pressed portion of the corresponding developing cartridge.

10. The image forming apparatus according to claim 1, wherein the movable member is provided on both sides of each developing cartridge in an axial direction of the developing roller.

11. The image forming apparatus according to claim 10, further comprising a connecting portion which connects the input portions of the movable members together.

12. The image forming apparatus according to claim 1, wherein the movable member is provided such that the operating portion, the abutting portion, and the input portion are arranged in order from a developing roller side in a direction in which the developing roller and the photosensitive drum oppose each other.

13. A developing cartridge configured to be detachably mountable in an apparatus body of an image forming apparatus, the developing cartridge comprising:

a developing roller which is configured to supply developer to a photosensitive drum;

a supporting shaft; and a movable member which is rotatably supported by the supporting shaft, wherein the movable member includes:

a main body which extends in a direction orthogonal to the supporting shaft, and is rotatably supported by the supporting shaft at a first end portion of the main body in a longitudinal direction thereof;

an input portion which is provided at a second end portion of the main body opposite to the first end portion, and to which a pressing force is input from an external member;

an abutting portion which is provided at a middle portion between the first and second end portions of the main body, and abuts a predetermined portion in the apparatus body while the movable member rotates about the supporting shaft by the input of the pressing force to the input portion; and an operating portion which is configured to apply a force to the supporting shaft for moving the developing cartridge from a first position where the developing roller contacts the photosensitive drum to a second position where the developing roller is separated from the photosensitive drum as the movable member is rotated with the abutting portion as a fulcrum by the input of the pressing force to the input portion while the abutting portion abuts the predetermined portion.

14. The developing cartridge according to claim 13, wherein the movable member is provided on both sides of the developing cartridge in an axial direction of the developing roller.

15. The developing cartridge according to claim 14, further comprising a connecting portion which connects input portions of the movable members together.

16. The developing cartridge according to claim 13, wherein the movable member is provided such that the operating portion, the abutting portion, and the input portion are arranged in order from the developing roller side in a direction in which the developing roller and the photosensitive drum oppose each other.

17. An image forming apparatus comprising:

an apparatus body;

a drum unit which holds a photosensitive drum, and is movably mounted along a first direction orthogonal to an axial direction of the photosensitive drum;

a developing cartridge which supports a developing roller for supplying developer to the photosensitive drum, and is configured to be detachably mounted in the drum unit, the developing cartridge including a supporting shaft extending along the axial direction;

a translation member in the apparatus body to be movable linearly in the first direction; and a movable member including:

a first part provided at one end thereof, and rotatably supported by the supporting shaft;

a second part provided at the other end thereof and located at a position abuttable on the translation member moving linearly to rotate the movable member about the supporting shaft;

a middle part provided between the first part and second part, and configured to abut the drum unit when the movable member rotates by abutment between the translation member and the second part.

* * * * *